US008334047B2

(12) United States Patent
Kelly et al.

(10) Patent No.: US 8,334,047 B2
(45) Date of Patent: Dec. 18, 2012

(54) PAPER COATING COMPOSITIONS, COATED PAPERS, AND METHODS

(75) Inventors: John P. Kelly, Midland, MI (US); Mark J. Pollock, Midland, MI (US); Holly L. Dunnill, Saginaw, MI (US); John G. Tsavalas, Hockessin, DE (US); James G. Galloway, Midland, MI (US); Alan B. Chaput, Jr., Midland, MI (US); Timothy M. Dellinger, Midland, MI (US); John A. Roper, III, Midland, MI (US); Greg W. Welsch, Midland, MI (US)

(73) Assignee: OMNOVA Solutions Inc., Fairlawn, OH (US)

( * ) Notice: Subject to any disclaimer, the term of this patent is extended or adjusted under 35 U.S.C. 154(b) by 460 days.

(21) Appl. No.: 12/451,993

(22) PCT Filed: Apr. 18, 2008

(86) PCT No.: PCT/US2008/005038

§ 371 (c)(1),
(2), (4) Date: Dec. 11, 2009

(87) PCT Pub. No.: WO2008/156519

PCT Pub. Date: Dec. 24, 2008

(65) Prior Publication Data

US 2010/0136356 A1 Jun. 3, 2010

Related U.S. Application Data

(60) Provisional application No. 60/936,155, filed on Jun. 18, 2007.

(51) Int. Cl.
*B32B 5/16* (2006.01)

(52) U.S. Cl. ..... 428/323; 428/327; 428/403; 428/407; 428/532; 428/537.1; 428/537.7; 427/361; 427/365; 427/366

(58) Field of Classification Search ..... 428/532, 428/537.1, 537.7, 403, 407, 323, 327; 427/361, 427/365, 366

See application file for complete search history.

(56) References Cited

U.S. PATENT DOCUMENTS

| | | | | |
|---|---|---|---|---|
| 3,853,579 | A | 12/1974 | Heiser | |
| 3,949,138 | A | 4/1976 | Heiser | |
| 4,477,518 | A | 10/1984 | Cremona et al. | |
| 4,829,102 | A | 5/1989 | Biale | |
| 4,885,320 | A | 12/1989 | Biale | |
| 4,972,000 | A | 11/1990 | Kawashima et al. | |
| 5,053,441 | A | 10/1991 | Biale | |
| 5,135,568 | A | 8/1992 | Fasano | |
| 5,147,940 | A | 9/1992 | Biale | |
| 5,162,289 | A | 11/1992 | Betts et al. | |
| 5,169,715 | A | 12/1992 | Maubert et al. | |
| 5,342,649 | A * | 8/1994 | Sarokin | 427/150 |
| 5,438,920 | A | 8/1995 | Koivukunnas et al. | |
| 5,902,453 | A | 5/1999 | Ruch | |
| 6,020,435 | A | 2/2000 | Blankenship et al. | |
| 6,074,528 | A | 6/2000 | Ruch | |
| 6,077,392 | A | 6/2000 | Ruch | |
| 6,107,014 | A | 8/2000 | Dagan et al. | |
| 6,139,961 | A * | 10/2000 | Blankenship et al. | 428/402 |
| 6,242,047 | B1 | 6/2001 | Johnson et al. | |
| 6,252,004 | B1 | 6/2001 | Blankenship et al. | |
| 6,364,997 | B1 | 4/2002 | Dagan et al. | |
| 6,387,213 | B1 | 5/2002 | Ruch | |
| 6,410,158 | B1 | 6/2002 | Johnson et al. | |
| 6,531,183 | B1 * | 3/2003 | Cason et al. | 427/361 |
| 6,673,451 | B2 | 1/2004 | Bardman et al. | |
| 6,777,075 | B2 | 8/2004 | Concannon et al. | |
| 6,863,775 | B2 | 3/2005 | Bobsein et al. | |
| 6,919,400 | B2 | 7/2005 | Nungesser et al. | |
| 6,979,481 | B2 | 12/2005 | Gaynor et al. | |
| 7,070,679 | B2 | 7/2006 | Cason et al. | |
| 7,101,459 | B2 | 9/2006 | Nisogi et al. | |
| 2001/0026869 | A1 | 10/2001 | Wicher et al. | |
| 2002/0040772 | A1 | 4/2002 | Johnson et al. | |
| 2004/0033323 | A1 | 2/2004 | Gaynor et al. | |
| 2004/0034147 | A1 | 2/2004 | Zama | |
| 2005/0016701 | A1 | 1/2005 | Nisogi et al. | |
| 2005/0031805 | A1 | 2/2005 | Fugitt et al. | |

(Continued)

FOREIGN PATENT DOCUMENTS

| | | |
|---|---|---|
| EP | 1 045 068 | 4/2000 |

(Continued)

OTHER PUBLICATIONS

Hansen, Eric. F., et al "Consolidation . . . " J. Am. Inst. for Cons. JAIC 1993, vol. 32, No. 1, Article 1. http://aic.stanford.edu/jaic/articles/jaic32-01-001_2.html (3pgs).

El-Sherbiny, S. "Factors Affecting Gravure Print Quality of Coated Paper, Part 2: Influence of Supercalendering . . . " Ink Maker. Sep. 2003. pp. 28-32.

Lee, D.I. TAPPI Coating Conference. "Development of High-Gloss Paper Coating Latexes." 1982 (11 pgs).

Lee, D.I. "A Fundamental study on Coating Gloss." Unknown Publication Date (18 pgs.).

(Continued)

*Primary Examiner* — Leszek Kiliman

(74) *Attorney, Agent, or Firm* — Arthur M. Reginelli; David G. Burleson

(57) ABSTRACT

Embodiments of the present disclosure include paper coating compositions, coated paper and/or paperboard, and methods of forming coated paper and/or paperboard with the paper coating compositions. The embodiments of the paper coating compositions contain high levels of hollow polymeric pigment relative to other pigments used in the paper coating composition (e.g., inorganic pigments). The paper coating compositions can provide the coated paper and/or paperboard with a wide variety of desirable features (e.g., high gloss, good smoothness, improved stiffness), while minimizing compaction (i.e., permanent deformation) of the underlying base paper.

20 Claims, 4 Drawing Sheets

U.S. PATENT DOCUMENTS

| | | | |
|---|---|---|---|
| 2006/0060317 | A1 | 3/2006 | Roding et al. |
| 2006/0062942 | A1 | 3/2006 | Gaynor et al. |
| 2007/0059444 | A1 | 3/2007 | Hladik et al. |
| 2008/0081175 | A1 | 4/2008 | Mukkamala |

FOREIGN PATENT DOCUMENTS

| | | | |
|---|---|---|---|
| EP | 1 186 707 B1 | | 2/2001 |
| EP | 1 197 503 | | 4/2002 |
| EP | 1197503 | * | 4/2002 |
| EP | 1 630 289 | | 8/2005 |
| EP | 1 602 783 | | 12/2005 |
| EP | 1630289 | * | 3/2006 |
| EP | 1 762 656 | | 9/2006 |
| WO | WO 99/63157 | | 12/1999 |
| WO | WO03/002330 | * | 1/2003 |
| WO | WO 03/002330 | | 1/2003 |
| WO | WO 2004/114014 | | 12/2004 |
| WO | WO 2006026283 | | 3/2006 |

OTHER PUBLICATIONS

Faust, Jerry. "Voice of the Customer—Time Inc." 2007 TAPPI Papermakers & PIMA International Leadership Conference. (2007). pp. 1-19.

International Search Report from related PCT Application PCT/US2008/005038, dated Oct. 7, 2008 (13 pgs).

* cited by examiner

PAPER COATING COMPOSITIONS, COATED PAPERS, AND METHODS

This application is a National Stage application under 35 U.S.C. 371 of PCT/US2008/00005038 filed Apr. 18, 2008, and published as WO 2008/156519 on Dec. 24, 2008, which claims priority in part from U.S. Provisional Application Ser. No. 60/936,155 filed Jun. 18, 2007, the entire content of which is incorporated herein by reference.

FIELD OF THE DISCLOSURE

The disclosure relates to paper coating compositions, coated papers, and methods for forming coated papers.

BACKGROUND

The appearance of printed text and/or images on paper can be affected by the presence of a coating on the paper. The coating can contain a mixture of clay, pigment, and binder. When ink is applied to an uncoated paper it is absorbed by the paper. When ink is applied to coated paper it sits on the coating. This attribute allows ink printed on coated paper to retain a crisp edge. As a result, coated paper generally produces sharper, brighter images and has better reflectivity than uncoated paper.

In producing a coated paper, the coating is first applied over a base paper, and then the coated base paper is consolidated in a calendering operation to make it more suitable for printing. Calendering affects the surface, as well as the whole paper structure, of a coated paper in many ways. For example, it reduces the roughness of the paper. Coated paper roughness depends particularly on the deformation of the fiber network during calendering. A decrease in roughness is often accompanied by an increase in gloss. Paper gloss, which is a surface related paper property, depends mainly on the deformation of the coating layer structure in calendering.

Calendering also affects the structure and characteristics of the base paper. For example, calendering can lead to the loss of opacity; a decrease in stiffness, and a reduction in strength of the base paper. This is especially true when the coated paper has been harshly calendered.

The coating may be finished in the calendering process to a high gloss, a gloss, a dull, or a matte (not glossy) finish. Other slight variations on these finish categories are possible. Coated paper is also categorized into grades by its brightness and gloss level. The grades can include premium coated paper (the brightest and highest quality grade of coated papers), coated #1, coated #2, coated #3, coated #4, coated #5, coated board, coated laser paper, coated CIS (coated 1-side), coated reply card, and coated SCA (Super Calendered Type A).

Improvements in producing the different grades of coated paper and the coating compositions used to form the coated paper continue to be a desire in the art.

SUMMARY

The present disclosure provides embodiments of paper coating compositions, coated paper and/or paperboard, and methods of forming coated paper and/or paperboard with the paper coating compositions. As discussed herein, embodiments of the paper coating compositions contain high levels of hollow polymeric pigment relative to levels of hollow polymeric pigment used in conventional paper coating compositions. The paper coating compositions can provide the coated paper and/or paperboard with a wide variety of desirable features (e.g., high gloss, good smoothness, improved stiffness), while minimizing compaction (i.e., permanent deformation) of the underlying base paper. As a result, embodiments of the present disclosure can provide coated papers and/or paperboards with improved stiffness and bulk factor values that are not otherwise possible with the level of gloss and smoothness being achieved in the present disclosure.

As used herein, "paper and/or paperboard" refers to a base paper of an amalgamation of fibers that can include, at least in part, vegetable and/or wood fibers, such as cellulose, hemicelluloses, lignin, and/or synthetic fibers. As appreciated, other components can be included in the base paper composition of the paper and/or paperboard. The paper and/or paperboard, as used herein, differ in their thickness, strength, and/or weight, but are both intended to be modified by the embodiments of the paper coating compositions and methods provided herein to form the coated paper and/or paperboard. For improved readability, the phrase "paper and/or paperboard" is replaced herein with the term "paper", with the recognition that "paper" encompasses both paper and/or paperboard unless such a construction is clearly not intended as will be clear from the context in which this term is used.

Embodiments of the present disclosure include a coated paper having a base paper and a coating formed from the paper coating composition of the present disclosure. The paper coating composition of the present disclosure is applied over at least one of a first and/or a second major surface of the base paper. The coating formed from the paper coating composition of the present disclosure can be used as a base coat, a top coat, and/or one or more intermediate coats between a base coat and a top coat of a coated paper.

For the various embodiments, the paper coating composition includes a binder and a high level of hollow polymeric pigment relative to other pigments used in the coating composition (e.g., inorganic pigments). For example, a high level of hollow polymeric pigment used in the paper coating composition can be in a range of about 25 parts to about 65 parts of the hollow polymeric pigment per 100 weight parts total pigment. As used herein, the term "parts" refers to parts on a dry basis, and, as is well known in the art, parts are based on 100 parts of pigment.

For the purposes of the present disclosure, the term "dry" means in the substantial absence of liquids and the term "dry basis" refers to the weight of a dry material. For example, the solids content of the pigment is expressed as a dry weight, meaning that it is the weight of materials remaining after essentially all volatile materials have been removed.

For the various embodiments, the high level of hollow polymeric pigment can have a variety of forms. For example, the hollow polymeric pigment can be discrete individual particles of pigment. In an alternative embodiment, the high level of hollow polymeric pigment can be formed as a cluster of a plurality of the discrete hollow polymeric pigments. As used herein, a "cluster" refers to a structure formed by a plurality of the discrete hollow polymeric pigments in which two or more of the hollow polymeric pigments are joined together. For the various embodiments, the hollow polymeric pigments can have a volume median diameter, measured by hydrodynamic chromatography, of greater than about 1 micron. In addition, in some embodiments, the paper coating composition can include two hollow polymeric pigments having volume median diameters, measured by hydrodynamic chromatography, that have a difference of at least twenty-five percent.

The base paper with its coating formed from the paper coating composition can then be calendered to provide a smoothness of the coating of less than 1.65 PPS-H5 (Parker PrintSurf 5). For the various embodiments, coated paper having this smoothness can be produced with the thermal rolls of the calender operating with substantially no heat added to the calendering device.

As used herein, "substantially no heat added to the calendering device" refers to an operating temperature in which substantially no additional heat is added to the calendering device beyond heat generated during the calendering process and/or heat added to the calendering device to maintain a constant operating temperature. As such, in some instances, "substantially no heat added to the calendering device" can be about 20° C. to about 65° C., depending on the calendering process. Surprisingly, the smoothness of less than 1.65 PPS-H5 is achieved at this calender operating temperature while minimally compacting (i.e., permanently deforming), if at all, the base paper of the coated paper.

In addition to the smoothness discussed herein, the coated paper can also have a high gloss. As used herein, a "high gloss" includes a TAPPI gloss value of 65 or greater as determined at a 75° angle of reflectance.

As used herein, "a," "an," "the," "at least one," and "one or more" are used interchangeably. The terms "comprises" and variations thereof do not have a limiting meaning where these terms appear in the description and claims. Thus, for example, a reactant mixture that comprises "a" binder can be interpreted to mean that the binder includes "one or more" binders.

The term "and/or" means one or all of the listed elements.

Also herein, the recitations of numerical ranges by endpoints include all numbers subsumed within that range (e.g., 1 to 5 includes 1, 1.5, 2, 2.75, 3, 3.80, 4, 5, etc.).

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

BRIEF DESCRIPTION OF THE FIGURES

FIGS. 1A and 1B are images (taken at different magnifications) of the coated paper in an uncalendered state. FIGS. 1C and 1D are images (taken at different magnifications) of the coated paper in a calendered state (140 kN/m at 65.6° C.).

DETAILED DESCRIPTION

Figure 1A:
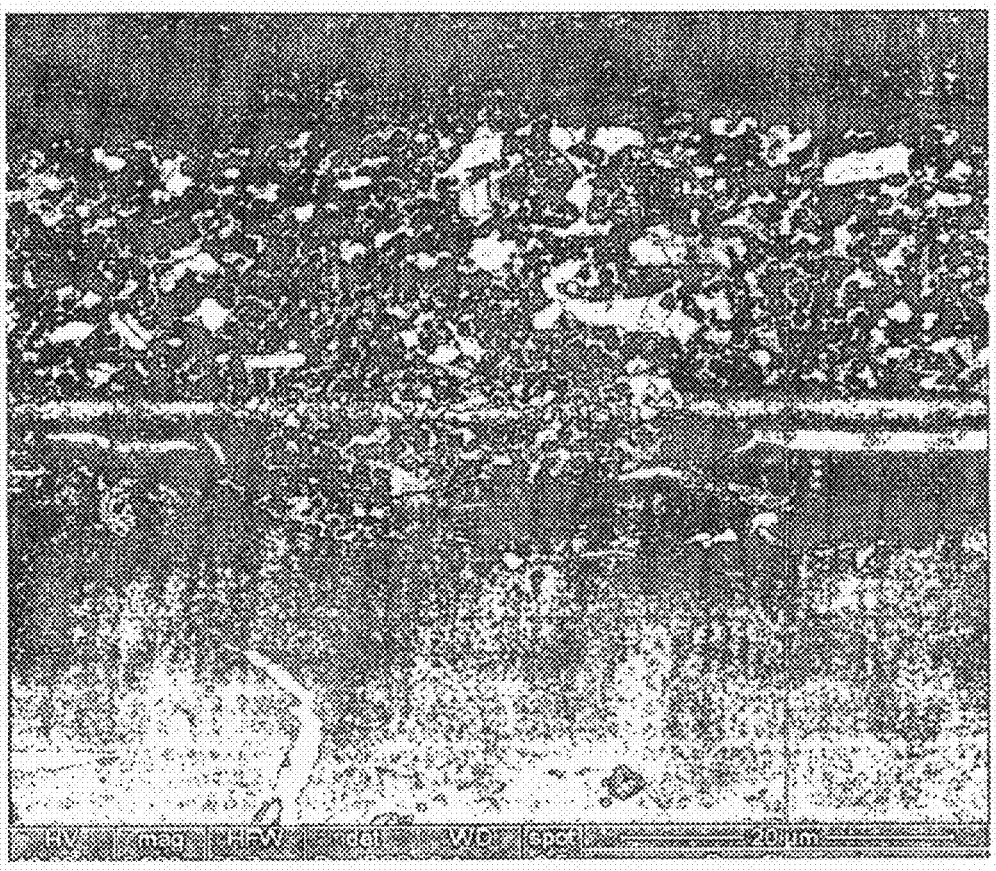
FIGS. 1A-1D are Scanning Electron Microscope (SEM) images of a coating of the paper coating composition according to one embodiment of the present disclosure on a precoated base paper.

The present disclosure provides embodiments of paper coating compositions, coated paper, and methods of forming coated paper with coatings formed from the paper coating compositions. As discussed herein, the use of the high levels of hollow polymeric pigment relative to other pigments (e.g., inorganic pigments) allows for the paper coating composition to preferentially undergo permanent deformation relative to the base paper during a calendering process.

The coating compositions of the present disclosure can provide the coated paper with a wide variety of desirable features (e.g., high gloss, good smoothness), while minimizing compaction (i.e., permanent deformation) of the underlying base paper. Since the base paper can undergo minimal, if any, compaction during the calendering process, the base paper can retain its original stiffness and bulk properties from before the calendering process while being provided with a coating that imparts a gloss of 65 or greater (TAPPI gloss value at a 75° angle of reflectance) and a smoothness of less than 1.65 PPS-H5 (Parker PrintSurf 5). In addition, the paper coating composition produces little to no calendering buildup while producing a coated paper that is not prone to mottling or burnishing, and also has an acceptable print strength and acceptable ink setting performance.

In addition, the features of the coated paper (e.g., high gloss, good smoothness) can be achieved at low calendering temperatures, including processes where substantially no heat is added to the calendering device. Operating at this low calendering temperature also results in little to no calendering buildup while producing a coated paper that is not prone to mottling or burnishing, and also results in an acceptable print strength and acceptable ink setting performance.

According to the various embodiments of the present disclosure, the coating composition can contain a binder and a high level of hollow polymeric pigment relative to levels of hollow polymeric pigment used in conventional paper coating compositions. For example, the high level of hollow polymeric pigment can range from about 25 parts to about 65 parts of the hollow polymeric pigment per 100 weight parts total pigment, with the remainder of the 100 parts of pigment being other pigments. In additional embodiments, the amount of hollow polymeric pigment used in the paper coating composition can be in a range of about 30 parts to about 50 parts per 100 weight parts total pigment. In various embodiments, the amount of hollow polymeric pigment used in the paper coating composition can range from about 35 parts to about 45 parts per 100 weight parts total pigment with the remainder of the 100 parts of pigment being other pigments.

As discussed herein, the use of the high level of hollow polymeric pigments in paper coating compositions of the present disclosure can improve the smoothness of a paper coated with such paper coating compositions, as compared to paper coated with coating compositions without the high level of hollow polymeric pigments. For example, World Patent Application WO99/63157 to Amick (hereinafter "WO99/63157") describes the use of a high level of hollow polymeric pigments in a paper coating composition, however, in the examples included in WO99/63157, each sample of paper coated with compositions including high levels of hollow polymeric pigments show a Parker Print smoothness value greater than the control. Specifically, the samples included in WO99/63157 prepared using coating compositions having high levels of hollow polymeric pigment all have a Parker Print smoothness value greater than 1.79 PP-H5, while the controls have Parker Print smoothness values of about 1 PP-H5. In other words, the smoothness of the coated paper worsened when a high level of hollow polymeric pigments is included in the coating composition. As one skilled in the art will appreciate, an increase in a smoothness value is actually a decrease in smoothness of the coated paper.

Similarly, it is recognized in the prior art that including high levels of hollow polymeric pigments in coating compositions has an adverse effect on the smoothness of the resulting coated paper. However, this recognition is premised on experiments where the level of hollow polymeric pigments in the coating composition is incrementally increased starting from a low level of hollow polymeric pigment (e.g., about 10 parts per 100 parts total pigment). When coated paper smoothness is measured from such incrementally increasing levels of hollow polymeric pigment coating compositions, the smoothness values show an increase in value. Due to the upward trend of the smoothness value, those skilled in the art have extrapolated the data to provide that as the level of hollow polymeric pigment included in the coating composition is increased, smoothness will experience a further increase.

However, embodiments of the present disclosure show that the smoothness value has a significant decrease when the level of hollow polymeric pigment reaches the high level of hollow polymeric pigment, as defined herein as about 25 parts to about 60 parts of the hollow polymeric pigment per 100 weight parts total pigment, with the remainder of the 100 parts of pigment being other pigments. In such embodiments, when the coating composition includes the high level of hollow polymeric pigments, the smoothness value of the coated paper produced therefrom actually improves. In fact, embodiments of the present disclosure provide coated paper having smoothness values better than the control, and less than 1.65 PP-H5.

A variety of hollow polymeric pigments are suitable for the coating composition of the present disclosure. For example, suitable hollow polymeric pigments can include, but are not limited to, those produced through an acid core process and/or those produced through an ester core process.

Examples of hollow polymeric pigments produced using an acid core process can be found in U.S. Pat. No. 4,468,498 to Kowalski, which is incorporated herein by reference in its entirety. Examples of hollow polymeric pigments produced using an ester core process can be found in U.S. Pat. Nos. 5,157,084 and 5,521,253 to Lee, both of which are incorporated herein by reference in their entirety.

Suitable hollow polymeric pigments are available in a range of particle sizes and void volumes. The average particle size typically ranges from about 0.35 to about 3.0 microns. As used herein, "average particle size" refers to the volume median diameter measured by hydrodynamic chromatography.

The latex can be prepared by stages which create a core and shell structure which subsequent to neutralization forms a hollow polymer particle. Therefore, the latex requires a swellable core and a shell sufficiently deformable to enable the core to swell but sufficiently hard to withstand deformation, thus creating a hollow particle on drying. The latex polymer particles of the present invention can be prepared by using batch or semi-continuous emulsion polymerization.

The degree of swelling by the polymer can be measured by viscometry or hydrodynamic chromatography (HDC).

The lack of an acidic core reduces the polarity of the polymer. Without such polarity the polymer is thought to adsorb surfactants well making them stable and less prone to coagulation or aggregation in larger particles. The lack of water sensitivity of the core is also thought to render the core receptive to being surrounded by the shell because the core is not attracted to the polymer-water interface on the surface of the particle and therefore is surrounded by the shell.

The present process also enables production of hollow polymer particles having crosslinked shells without a post-encapsulating step with crosslinking monomers. Thus, the acid-free cores can be encapsulated with crosslinked polymers directly and the cores can be hydrolyzed and swelled with bases such as NaOH at elevated temperatures while stretching the crosslinked shells. This is in contrast to other processes in which the procedure is to encapsulate an acid containing core with an uncrosslinked shell, swell the core, then crosslink the shell.

"Hollow polymer latex particle", as used herein, is meant to include a latex particle which is not completely solid. Such particle morphology can include various void structures such as uniform microvoids or hemispherical particles with voided centers. The more preferred hollow polymer latex particles are those having a centered void and a particle wall thickness aspect ratio of inner diameter to outer diameter of from about 0.1 to about 0.9. The hollow polymer latex particles having a centered void have greater utility in coatings than those structures having microvoids or hemispherical particles with voided centers.

The more specific hollow polymer particle contemplated by the present invention is derived from a polymer particle which comprises a hydrolyzable, neutralizable core as a seed, an intermediate copolymer layer with a relatively high glass transition temperature (Tg) that is compatible with the copolymer of the seed, and a rigid copolymer shell which is hydrophobic, crosslinked and is also of a copolymer having a relatively high Tg. The polymer particle is then hydrolyzed at a temperature higher than the Tg of the copolymer of the shells to produce the hollow polymer particles. The terms "hollow latex", "hollow polymer particle" and "hollow copolymer particle" and "hollow polymer latex particle" are all used herein to indicate the polymer particle produced by emulsion polymerization followed by high temperature neutralization to produce expansion. Optionally, these expanded hollow polymer particles can be further encapsulated with a more crosslinked rigid copolymer, if a greater degree of dimensional stability is needed during drying.

Latex Monomers

Representative monomers useful to produce hollow latexes of the present invention include acrylate monomer, methacrylate monomer, monovinyl aromatic monomer, aliphatic conjugated diene monomer, vinylidene halide or vinyl halide monomer, vinyl esters of carboxyl acids containing from 1 to 18 carbon atoms, such as vinyl acetate or vinyl stearate, methacrylonitrile and acrylonitrile. The monoethylenically unsaturated carboxylic acid monomer is used in the shell polymers but is nonexistent in the core polymers. Various mixtures of these monomers are also employable. Crosslinking agents could also be used to decrease the swellability of the polymer or for various other conventionally known reasons for the addition of crosslinking agents to polymers.

The term "(meth)acrylate" monomers is meant those monomers which are used to prepare the swellable copolymers of the present latexes by the processes of the present invention including conventionally known acrylates such as alkyl esters of acrylic acid represented by the formula CH2=CHCOOR, wherein R is from 1 to 16 carbon atoms and substituted alkyls represented by the formulas —CH2Cl; —CH2CH2OH; and

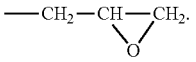

The term "(meth)acrylate" monomer(s) as used herein is meant also to include the monovinyl acrylate and methacrylate monomers. The (meth)acrylates can include esters, amides and substituted derivatives thereof. Generally, the preferred (meth)acrylates are C1-C8 alkyl acrylates or methacrylates.

Examples of suitable (meth)acrylates include methyl acrylate, ethyl acrylate, butyl acrylate, hexyl acrylate, 2-ethyl hexyl acrylate, octyl acrylate and isooctyl acrylate, n-decyl acrylate, isodecyl acrylate, tert-butyl acrylate, methyl methacrylate, butyl methacrylate, hexyl methacrylate, isobutyl methacrylate, isopropyl methacrylate as well as 2-hydroxyethyl acrylate and acrylamide. The preferred (meth)acrylates are methyl acrylate ethyl acrylate, butyl acrylate, 2-ethyl hexyl acrylate, octyl acrylate, isooctyl acrylate, methyl methacrylate and butyl methacrylate.

The term "monovinyl aromatic" monomer, as used herein, is meant to include those monomers with a radical of the formula

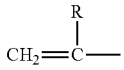

wherein R is hydrogen or an alkyl having from 1 to 4 carbon atoms, attached directly to an aromatic nucleus containing from 6 to 10 carbon atoms, including those wherein the aromatic nucleus is substituted with alkyl or halogen substituents. The preferred monovinyl aromatic monomers are styrene and vinyltoluene.

The term "aliphatic conjugated diene", monomer, as used herein, is meant to include compounds such as 1,3-butadiene, 2-methyl-1,3-butadiene, piperylene (1,3-pentadiene), and other hydrocarbon analogs of 1,3-butadiene. Other monomers inclusive as aliphatic conjugated dienes are halogenated compounds such as 2-chloro 1,3-butadiene.

"Vinylidene halides" and "vinyl halides" suitable for this invention include vinylidene chloride and vinyl chloride, which are highly preferred Vinylidene bromides and vinyl bromide can also be employed.

The term "monoethylenically unsaturated carboxylic acid" monomer, as used herein, is meant to include those monocarboxylic monomers such as acrylic acid, and methacrylic acid; dicarboxylic monomers such as itaconic acid, fumaric acid, maleic acid, and their monoesters.

The C3-C8 α,β-ethylenically unsaturated carboxylic acid monomer contemplated include monomers represented by the formula:

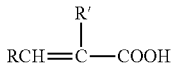

where R is H and R' is H, C1-C4 alkyl, or —CH2COOX; R is —COOX and R' is H or —CH2COOX; or R is CH3 and R' is H; and X is H or C1-C4 alkyl.

Acrylic or methacrylic acid or a mixture thereof with itaconic or fumaric acid are included as well as crotonic and aconitic acid and half esters of these and other polycarboxylic acids such as maleic acid. Although such monomers are contemplated as monomers of the shell stages of the present invention, such acids are not contemplated to be part of the core stage.

The term "crosslinking" monomer is meant to include monomers conventionally known in the art as useful for crosslinking polymerizable monomers. Examples of such monomers typically include di- or trifunctional monomers such as divinyl benzene, ethylene glycol dimethacrylate, 1,3-butylene glycol dimethacrylate, trimethylol propane trimethacrylate, allyl methacrylate or diene functional monomers such as butadiene. The crosslinking monomer can be present in the hollow polymer particles of the present invention in the core or shell phases.

High-temperature expandable latexes can be made by conventional emulsion polymerization processes including batch or semi-continuous and either seeded or non-seeded emulsion polymerization.

Compositions of Hollow Polymer Particle Phases

A. The Core Phase

The core or seed of the present hollow polymer particles is a copolymer which does not comprise monoethylenically unsaturated carboxylic acid monomer but is swellable at temperatures greater than the Tg of the core copolymer. Monomers most suitable for the core include any base-hydrolyzable (meth)acrylic ester monomers. The core copolymer is typically crosslinked and is to be hydrolyzable with alkaline solutions at temperatures greater than the Tg of the copolymer.

The most preferred composition of the core is ethyl acrylate, methyl acrylate and allyl methacrylate. The ratios preferred for the monomers are based on 100 parts by weight of the core total as follows: from about 49 to about 80 parts ethyl acrylate; from about 20 to about 50 parts methyl acrylate; and from about 0.05 to about 1 parts allyl methacrylate. To enable the total number of parts to work out to 100 parts a skilled artisan would understand that if allyl methacrylate is present in an amount of 0.05 parts, the ethyl acrylate will be present in an amount of about 79.95 parts. The most preferred composition for the core is 59.5 parts ethyl acrylate, 40 parts methyl acrylate and 0.5 parts allyl methacrylate, methyl acrylate being the more readily hydrolyzable moiety.

The core should be present in the latex particle in an amount of from about 2 to about 15 parts by weight based on the total weight of the latex. The more preferred amount of the core to the total latex particle is about 3 parts to about 10 parts.

B. The Intermediate Shell Phase

The intermediate shell is an intermediate copolymer layer with a relatively high Tg compared to the core and is made up of monomers that are compatible with the copolymer of the seed or core. The intermediate shell can comprise the somewhat hydrophilic monomers such as ethyl methacrylate, methyl methacrylate and the hydrophobic harder monomers such as styrene, vinyl toluene, α-methyl styrene.

The preferred composition of the intermediate shell is a copolymer of methyl methacrylate, styrene, methacrylic acid and allyl methacrylate or divinyl benzene. The ratios preferred for the monomers based on 100 parts by weight of the total intermediate shell are as follows: from about 65 to about 99 parts methyl methacrylate; from 0 to about 30 parts styrene; from about 1 to about 3 parts methacrylic acid; and from 0 to about 2 parts allyl methacrylate or divinyl benzene. The most preferred composition for the intermediate shell is 72.5 parts methyl methacrylate; 25 parts styrene; 2 parts methacrylic acid; and 0.5 parts allyl methacrylate or divinyl benzene.

The intermediate shell should be present in the latex in an amount from about 15 to about 50 parts by weight based on the total weight of the latex. The most preferred amount of the intermediate shell to the total latex particle is about 25 parts C. The Outer Shell Phase The outer shell is a rigid copolymer which is hydrophobic, crosslinked and is also of a copolymer having a relatively high Tg. The composition of the outer shell will preferably incorporate styrene; methyl methacrylate; methacrylic acid; acrylic acid and allyl methacrylate or divinyl benzene. The ratios preferred for the monomers are based on 100 parts by weight of the total outer shell as follows: from about 67 to about 99 parts styrene; from 0 to about 25 parts methyl methacrylate; from about 1 to about 3 parts methacrylic acid; from 0 to about 2 parts acrylic acid; and from about 0.2 to about 10 parts allyl methacrylate or divinyl benzene. The crosslinking monomer can be desirably tapered from 0.1 part to 10 parts for balanced expansion and dimensional stability of hollow latexes. The most preferred composition for the outer shell is 94 parts styrene, 2 parts methacrylic acid and 2 to 5 parts allyl methacrylate or divinyl benzene.

The outer shell should be present in the latex in an amount from about 50 to about 83 parts by weight based on the total weight of the latex. The most preferred amount of the outer shell to the total latex particle is about 75 parts.

A preferred embodiment of the hollow polymer particle is that wherein

A. the core copolymer phase is from about 2 to about 15 parts by weight of the hollow polymer particle, and, based on 100 parts by weight of the acid-free hydrophilic core copolymer phase, the core is made of from about 99 to about 99.99 parts (meth)acrylate monomers, vinyl ester monomers of carboxylic acids or a mixture thereof, and from about 0.01 to about 1 part of one or more crosslinking monomers;

B. the intermediate shell copolymer phase is from about 15 to about 50 parts by weight of the hollow polymer particle, and, based on 100 parts by weight of the intermediate shell copolymer phase, the intermediate shell is made of from about 65 to about 98 parts (meth)acrylate monomers having a Tg for their copolymer greater than 50° C.; and from about 1 to about 3 parts vinyl acid monomers; and from 0 to about 30 parts monovinyl aromatic monomers, and from 0 to about 2 parts crosslinking monomers;

C. the outer rigid shell copolymer phase is from about 50 to about 83 parts by weight of the hollow polymer particle, and, based on 100 parts by weight of the outer shell copolymer phase, the outer shell is made of from about 67 to about 99 parts monovinyl aromatic monomers; and from about 1 to about 3 parts vinyl acid monomers; and from about 0.5 to about 10 parts crosslinking monomers; and from 0 to about 25 parts (meth)acrylate monomers having a Tg for their copolymer greater than 50° C.

Preparation of the Hollow Latexes

The latexes can be made by means of emulsion polymerization. The core or seed is prepared first and the shells are polymerized subsequently. The expansion of the latexes to produce the hollow morphology can occur as a post-polymerization step.

The temperature during the emulsion polymerization will be anywhere from 50° C. to 150° C.; preferably 70° C. to 100° C. The polymerization time can be from 2 to 10 hours depending upon the pressure and temperature.

The expansion step is achieved by exposing the latex to a strong alkaline solution, such as sodium hydroxide, in an amount of from about 0.75 to about 1.5 equivalents of base, based on all the acids in the shell phases and the more easily hydrolyzable acrylate esters in the core, such as methyl acrylate. The expansion of the hollow latexes should occur between 100° C. to 150° C.; preferably between 110° C. to 140° C. When the crosslinking of the shells is greater, the temperature of the expansion step should also be greater. Solvents can aid the swelling in the expansion step. The expansion time can range from about 0.5 to about 10 hours; preferably from about 2 to about 5 hours.

The void volume of the hollow polymeric pigments can range from about 15 percent to about 60 percent. Preferred hollow sphere plastic pigments have an average particle size of about 0.8 to 1.2 microns and a void volume of about 40 percent to 55 percent. Suitable hollow polymeric pigment include HS 3000NA hollow polymeric pigment, HS 3020NA hollow polymeric pigment, UCARHIDE 4001, and/or UCARHIDE 98, all of which are commercially available from The Dow Chemical Company, or Rhopaque HP 1055, Ropaque Ultra E, and/or Ropaque OP-96 available from the Rohm & Haas Company (Philadelphia, Pa.).

Mixtures of the hollow polymeric pigments can also be employed in the coating composition. Such compositions can be considered polymodal systems, where "polymodal" refers to a coating composition including hollow polymeric pigments with at least two different dimensional qualities, e.g., volume median diameters, measured by hydrodynamic chromatography. The coating compositions can be bimodal, with two different sized hollow polymeric pigments. Coating compositions with more than two different sized hollow polymeric pigments, however, are also possible.

In embodiments of the present disclosure, blending two different sized hollow polymeric pigments can produce a coating with enhanced coating properties including smoothness, gloss, opacity, porosity, and combinations thereof. In addition, the use of different sized hollow polymeric pigments can be used to enhance a particular property, while not adversely affecting other coating properties. Similarly, different sized hollow polymeric pigments can be combined in different ratios, applied at different coat weights, and calendered at different pressures to obtain a coating composition that produces a coating with particular properties for a particular purpose.

In some embodiments, the paper coating composition can include a binder, a first hollow polymeric pigment having individual particles with a first dimensional quantity and a second hollow polymeric pigment having individual particles with a second dimensional quantity based on the first dimensional quantity of the first hollow polymeric pigment. In various embodiments, the second dimensional quantity can be at least twenty-five percent smaller than the first dimensional quantity of the first hollow polymeric pigment. In addition, in various embodiments, the second dimensional quantity can be at least fifty percent smaller than the first dimensional quantity of the first hollow polymeric pigment.

In some embodiments, the first and second dimensional quantities of the first and second hollow polymeric pigments can be volume median diameters, measured by hydrodynamic chromatography. As such, the first hollow polymeric pigment can have a volume median diameter of a first predetermined value, and the second hollow polymeric pigment can have a volume median diameter of a second predetermined value that is at least twenty-five percent smaller than the first predetermined value of the first hollow polymeric pigment. In various embodiments, the second predetermined value of the volume median diameter of the second hollow polymeric pigment can be at least fifty percent smaller than the first predetermined value of the first hollow polymeric pigment. Additionally, in some embodiments, the volume median diameter of the first and second hollow polymeric pigments can be in a range from about 300 nanometers to about 1,100 nanometers.

In some embodiments, it does not always follow that incorporating more of, for example, the second hollow polymeric pigment with lower gloss and smoothness, will result in a coating composition that has properties that are a direct average of the two systems. Rather, in some embodiments, the properties are not enhanced in a linear manner and may even improve over both systems. For example, the gloss and smoothness for a system with 19 weight percent of a second hollow polymeric pigment can result in a coating composition that forms a coated paper that is glossier and smoother than a coated paper formed with a coating composition with either the first or second hollow polymeric pigment alone.

As discussed herein, in some embodiments, the use of two different sized hollow polymeric pigments can be used to tailor the coating composition to have certain properties. For example, if it is desirable to produce a coating with a smoothness and gloss within a certain range, in some embodiments, the use of two different sized pigments can be used to create a coating composition to produce the coating.

In addition, the use of two different sized pigments can be used to obtain certain properties of a coating while using different processing conditions, for example, lower calendering temperatures and pressures, which can help to decrease the effect that higher temperatures and pressures can have on paper's stiffness. In addition, in embodiments where the goal is to produce a coating with the same properties while reducing the cost, the use of blends can reduce the amount of hollow polymeric pigments used in the coating composition and/or reduce the coat weight down while obtaining equivalent coating properties, decreasing the cost of the coating process.

Also, as one skilled in the art will appreciate, the blend of the hollow polymeric pigments can depend on the inorganic pigments included in the coating composition. As such, in some embodiments, to obtain a coating with the desired properties, different ratios of blends of hollow polymeric pigments may be blended with varying inorganic pigments.

Not wishing to be bound by theory, the use of two different sized hollow polymeric pigments can result in enhanced coating properties while using low calendering temperatures and pressures as a result of increased packing efficiencies related to using a smaller polymeric pigment with a larger polymeric pigment. As one can appreciate, the smaller polymeric pigments can shift around and in between the spaces of the larger polymeric pigments, filling in spaces between the larger polymeric pigments. In such instances, a ratio of the first hollow polymeric pigment to the second hollow polymeric pigment in the coating composition can be determined that allows for the packing of the polymeric pigments to achieve a series of contiguous hollow polymeric pigments that extends through a thickness of the coating. Such an arrangement can cause the coating to be more compressible/collapsible, causing the paper to be less permanently deformed during the calendering process, increasing the stiffness of the paper.

For example, in some embodiments at least 50 percent of the total hollow pigment can be deformed relative to a non-deformed hollow polymeric pigment of the coating. Additionally, the base paper of the coated paper can have a thickness that remains unchanged relative an original thickness of the base paper prior to receiving the coating. In some embodiments, the base paper of the coated paper can have a thickness that changes no more than about 10 percent relative to an original thickness of the base paper prior to receiving the coating.

In some embodiments, the paper coating composition can include the second hollow polymeric pigment in about 5 parts to about 40 parts per 100 weight parts total hollow polymeric pigment of the coating composition. In various embodiments, the paper coating composition can include the second hollow polymeric pigment in about 15 parts to about 30 parts per 100 weight parts total hollow polymeric pigment of the coating composition. In addition, the first and second hollow polymeric pigments can provide less than about 30 parts per 100 weight parts of pigment of the paper coating composition. Additionally, the first and second hollow polymeric pigments can provide from about 20 parts to about 30 parts per 100 weight parts of pigment of the paper coating composition.

For the various embodiments, the high level of hollow polymeric pigment can have a variety of forms. For example, the hollow polymeric pigment can be discrete individual particles of pigment. In an alternative embodiment, the high level of hollow polymeric pigment can be formed as a cluster having a plurality of discrete hollow polymeric pigments joined together. As used herein, a "cluster" refers to a structure formed by a plurality of discrete hollow polymeric pigments in which two or more of the hollow polymeric pigments are joined together. As used herein, "joined together" refers to chemically bonding the two or more discrete hollow polymeric pigments to form the clusters. In one embodiment, the clusters of the hollow polymeric pigment include 2 or more of the discrete hollow polymeric pigments. In another embodiment, the clusters include 2 to 20 hollow polymeric pigments that have been joined together. In yet another embodiment, the clusters can have a variety of shapes including, but not limited to, symmetrical (e.g., spherical) to asymmetrical (e.g., conical, grape cluster like, raspberry like, and/or bar) shapes. Mixtures of the different shapes of the clusters can also be employed in the coating composition of the present disclosure.

A variety of processes for joining two or more of the hollow polymeric pigments into clusters are possible. For example, the process for joining two or more of the hollow polymeric pigments can include a controlled agglomeration with either a salt or with a cationic surfactant. Examples of joining two or more of polymeric pigments can be found in EP Publication No. EP1784537 A0 to Tsavalas et al., which is incorporated herein by reference in its entirety. Other agglomeration techniques are also possible.

Suitable agglomerating agents include, for example: cationic surfactants such as cetyl pyridinium chloride, quaternary ammonium salts, and ethoxylated quatemary ammonium salts; positively or negatively or amphoterically charged polyelectrolytes such as cationic starch, cationic polyacrylamide, polyethyleneimine (PEI), polyacrylamide-co-acrylic acid, poly(diallyldimethylammonium chloride), (PDADMAC), and the like; neutral water-soluble polymers such as, for example, polyethylene oxide (PEO), and partially hydrolyzed polyvinyl acetate; and agglomerating salts such as, for example, calcium chloride, zinc chloride, aluminum chloride, and ammonium sulfate.

A colloidally stabilized particle to which the hollow polymeric pigments adhere can also be a suitable agglomerating agent. Examples of such agglomerating agents include cetyl pyridinium chloride and poly(diallyldimethylammonium chloride). Mixtures of agglomerating agents can also be employed. The agglomerating agent is employed in an amount sufficient to form an agglomeration of the hollow polymeric pigments with a weight average cross-sectional dimension of greater than about 1 micron. The amount of agglomerating agent advantageously is sufficient to convert at least about 30 weight percent of the solids of the hollow polymeric pigment to clusters. In additional embodiments, the agglomerating agent can be sufficient to convert at least about 50 weight percent, at least about 75 weight percent and/or at least about 90 weight percent of the solids of the hollow polymeric pigment to clusters. For the various embodiments, from about 0.01 to about 1.0 grams of agglomerating agent is employed per gram of solids of the hollow polymeric pigment. In an additional embodiment, from about 0.03 to about 0.5 grams of agglomerating agent can be employed per gram of solids of the hollow polymeric pigment.

In addition, clusters of the joined hollow polymeric pigment can be formed through a shearing process in which a slurry of hollow polymeric pigment is sprayed through a nozzle. U.S. Pat. No. 6,013,594, entitled "Spray Dried Polymer for Catalyst Support" and incorporated herein by reference in its entirety, provides an approach to making agglomerated latex particles using a shearing process.

For the various embodiments, the resulting clusters of the hollow polymeric pigments can have a weight average cross-sectional dimension of greater than about 1 micron. In one embodiment, the clusters of the hollow polymeric pigments can have a weight average cross-sectional dimension of about 2 to about 15 microns. For the various embodiments, the amount of hollow polymeric pigment used in the paper coating composition can be in the ranges as provided herein. In addition, embodiments of the paper coating composition can include at least 50 percent by weight of the hollow polymeric pigment in the cluster form.

For the various embodiments, the binder for the paper coating composition is selected from the group consisting of a synthetic latex, a starch or other natural binder such as a protein (e.g., soy, casein, albumin), polyvinyl alcohol, carboxymethyl cellulose, hydroxymethyl cellulose, polyvinyl alcohols, polyacrylate salt, and mixtures thereof. In one embodiment, the binder employed in the paper coating formulation is a synthetic latex. Specifically, the synthetic latex can be selected from the group of a polymerized form of styrene, butadiene, acrylonitrile, butyl acrylate, methyl methacrylate, styrene-butadiene, styrene-butadiene-acrylonitrile, styrene-acrylic, styrene-butadiene-acrylic, vinyl acetate, and mixtures thereof. Additional examples of monomers that can be used in the preparation of synthetic latex include mixtures of ethylene and vinyl acetate, and esters of acrylic acid and/or methacrylic acid.

In addition, the binders of the present disclosure can be carboxylated. For example, the synthetic latex binders provided herein can be carboxylated, i.e. copolymerized with a carboxylic acid.

For the various embodiments, the binder of the paper coating composition can be an aqueous dispersion of a polymer. As appreciated, the aqueous portion of the binder is, for the most part, evaporated during the manufacture of the coated paper, as discussed herein. In one embodiment, the synthetic latex binder is an example of such an aqueous dispersion of a polymer. In addition, the synthetic latex can have a monomodal or polymodal, e.g. bimodal, particle size distribution. Mixtures of binders can also be used in the paper coating composition.

The mean particle size of the binder in the coating composition is generally about 450 to about 5000 angstroms. Coating compositions with binders having relatively smaller particle size typically exhibit improved coating strength because smaller particles provide a greater surface area per unit weight with which to bind the other coating components.

A wide variety of commercially available binders are available. Examples of suitable latex binders include: CP 615NA, CP 638NA, DL 920, DL 966, PROSTAR 5401, and CP 692NA, manufactured by The Dow Chemical Company; GenFlo 557 and GenFlo 576, manufactured by Omnova Solutions Inc.; and Acronal S 504 and Acronal S 728, manufactured by BASF Corporation. A suitable starch binder can include Penford Gum PG290 (Penford Products Co., Cedar Rapids Iowa).

For the purposes of the disclosure, the binder can be selected and the amount used can be sufficient to ensure that the binder has sufficient adhesive properties and coating strength for use in the manufacture of the coated paper. For the various embodiments, the amount of binder in the paper coating composition should provide adequate coating strength to resist picking. Surprisingly, the percentage of binder needed for the paper coating composition can be less than about 10 percent by weight of the paper coating composition. For example, a suitable percentage for the binder can include, but is not limited to, a range between about 6 percent and about 10 percent by weight of the paper coating composition. In one embodiment, the percentage of binder that can be used in the paper coating composition can be about 5 percent to about 7 percent by weight of the coating composition.

As discussed herein, the paper coating composition can include additional pigments beyond the hollow polymeric pigments to attain the 100 weight parts total pigment. For the paper coating compositions that include the discrete individual hollow polymeric pigment (i.e., the non-clustered hollow polymeric pigment) the additional pigment can be an inorganic pigment. Examples of the inorganic pigment can include kaolin clay, talc, calcined clay, structured clay, ground calcium carbonate, precipitated calcium carbonate, titanium dioxide, aluminum trihydrate, satin white, silica, zinc oxide, barium sulfate, and mixtures thereof. Calcium carbonate is a particularly preferred inorganic pigment.

In some embodiments, the additional pigment added to the composition to attain 100 weight parts total pigment can be an inorganic pigment and/or a solid polymeric pigment. As used herein, solid polymeric pigments include those polymeric pigments that have no more than about a 5 percent void volume. Examples of suitable solid polymeric pigments include, but are not limited to, Plastic Pigment 722, Plastic Pigment 730, or Plastic Pigment 756 available from The Dow Chemical Company.

Additionally, in various embodiments where the paper coating composition includes the discrete individual hollow polymeric pigments (i.e., the non-clustered hollow polymeric pigment), the additional pigments added to the composition to attain 100 weight parts total pigment can be substantially free of solid polymeric pigments.

The particle size distribution of the inorganic pigment used in the coating compositions of the present disclosure also can have an influence on the gloss of the coated paper formed with such coating compositions. For example, when calcium carbonate pigments having a relatively coarse particle size distribution (e.g., HYDROCARB 60, Omya, Inc, Proctor Vt., USA) are used with the paper coating composition it is found to provide better gloss and smoothness values for the coated paper as compared to the use of calcium carbonate pigments having a relatively fine particle size distribution (e.g., HYDROCARB 90, Omya, Inc, Proctor Vt., USA).

In some embodiments, the particles can have a coarse particle size distribution where the particles have a particle size distribution in which less than about 65 percent of the inorganic pigment is less than about 2 microns in diameter (as specified by the manufacturer). For example, HYDROCARB 60 has a median particle diameter of about 1.4 microns (as specified by the manufacturer). As appreciated, coarse particle size distributions having values other than 65 percent (e.g., 70 percent, 75 percent, 80 percent etc.) of the inorganic pigment being less than about 2 microns in diameter (as discussed above) are also possible for providing improved gloss and smoothness relative to inorganic pigments having a relatively fine particle size distribution.

Coating compositions including fine particle size distributions of calcium carbonate pigments also gave good results for gloss and smoothness.

As used herein, "fine particle size distribution" refers to particles having a particle size distribution in which about 90 percent of the inorganic pigment is less than about 2 microns in diameter (as specified by the manufacturer). For example, HYDROCARB 90 has a median particle diameter of about 0.65 microns (as specified by the manufacturer).

Typically, fine particle size distributions of inorganic pigments are expected to provide coatings with higher gloss and better smoothness as compared to coarse particle size distributions of inorganic pigments. However, when high levels of hollow polymeric pigment are used in the coating compositions of the present disclosure, it has been found that the normally lower glossing coarse particle size distributions of inorganic pigments, such as HYDROCARB 60, can now obtain higher gloss for the coated paper than can be attained with conventional high glossing fine particle size distributions of inorganic pigments, such as HYDROCARB 90, with the other factors and components of the coating composition being the same.

While not wishing to be bound by theory, the use of the coarse particle size distributions of inorganic pigment appear to provide for better gloss and smoothness as compared to the fine particle size distributions of inorganic pigment because the coarse particle size distributions of inorganic pigment allow for better packing of the hollow polymeric pigments. Since the coarse particle size distributions of inorganic pigment have fewer particles per unit volume (given a certain volume ratio of the coarse inorganic pigment and the hollow polymeric pigment), there is more space for the hollow polymeric pigment to become continuous in the coating composition. This then leads to the improvements in packing and compressibility of the hollow polymeric pigments in the paper coating composition, as discussed herein.

In an alternative embodiment, when clusters of the hollow polymeric pigment, as discussed herein, are used in the paper coating composition, the composition also includes both the inorganic pigment and the binder, as discussed herein. In addition, the paper coating composition having the clusters of the hollow polymeric pigment can also include additional polymer pigments in the form of discrete individual particles of pigment, as opposed to the clusters of hollow polymeric pigment. These discrete individual particles of polymeric pigment are solid polymeric pigment and/or hollow polymeric pigment. Examples of suitable hollow polymer pigments include those discussed herein. Examples of suitable solid polymeric pigments include, but are not limited to, Plastic Pigment 722, Plastic Pigment 730, or Plastic Pigment 756 available from The Dow Chemical Company.

For the paper coating composition including the clusters of the hollow polymeric pigment, the clusters of the hollow polymeric pigment can compose at least about 25 parts to about 65 parts per 100 parts pigment; the inorganic pigment can compose from about 35 parts to about 75 parts per 100 parts pigment; the binder can compose from about 6 parts to about 25 parts per 100 parts pigment; and the additional polymeric pigment can compose from about 0 parts to about 25 parts per 100 parts pigment, all of which are based on 100 weight parts total pigment. In an additional embodiment, the clusters of the hollow polymeric pigment used in the paper coating composition can compose from about 30 parts to about 50 parts per 100 parts pigment; the inorganic pigment can compose from about 55 parts to about 65 parts per 100 parts pigment; the binder can compose from about 6 parts to about 25 parts per 100 parts pigment; and the additional polymeric pigment can compose from about 0 parts to about 25 parts per 100 parts pigment, all of which are based on 100 weight parts total pigment.

If desired, conventional additives can also be incorporated into the embodiments of the paper coating compositions in order to modify the properties thereof. Examples of these additives include conventional thickeners, dispersants, dyes and/or colorants, preservatives, biocides, anti-foaming agents, optical brighteners, wet strength agents, lubricants, water retention agents, crosslinking agents, surfactants, and pH control agents, and mixtures thereof. The use of other additives in the paper coating composition is also possible. Practitioners skilled in the art are aware of how to select the appropriate additional additives to achieve the desired final product attributes.

The rheology of the paper coating composition can vary widely as is known in the art, depending on the result desired. The paper coating composition solids content advantageously is at least about 25 percent to about 65 percent, and in one embodiment is from about 30 to about 50 percent.

For the embodiments of the present disclosure, the paper coating composition is applied over at least one of a first and/or a second major surface of a base paper before a calendering process. The base paper can be a dried amalgamation of fibers that can include, at least in part, vegetable and/or wood fibers, such as cellulose, hemicelluloses, lignin, and/or synthetic fibers. As appreciated, other components can be included in the base paper composition of the paper and/or paperboard.

The paper coating composition can be applied to the base paper using a number of different coating techniques. Examples of these techniques include rod, grooved rod, curtain coating, stiff blade, applicator roll, fountain, jet, short dwell, slotted die, bent blade, bevel blade, air knife, bar, gravure, size press (conventional or metering), spray application techniques, wet stack, and/or application during the calendering process. Other coating techniques are also possible.

In one embodiment, one or more layers of the paper coating composition are applied on at least one side of the base paper using a rod and/or a stiff blade coating technique. In one embodiment, the total dried coat weight applied per side is about 0.5 to about 20 $g/m^2$, and in an additional embodiment about 4 to about 10 $g/m^2$. In one embodiment, the coating can be applied to both sides of the base paper to ensure that the printed images on both sides of the printing sheet are of comparable quality. In one embodiment, the paper coating composition can be applied as a single layer to the base paper.

The layer(s) of the paper coating composition is then dried. Drying of the paper coating composition can be accomplished by convection, conduction, radiation, and/or combinations thereof.

In addition, the coated paper can also include a base coat between the base paper and the coating of the present disclosure. As used herein, a "base coat" refers to a pigmented or unpigmented base coat that can lay under the paper coating composition of the present disclosure and can include a binder. When the base coat is pigmented, the pigment can be selected from the group consisting of kaolin, talc, calcined clay, structured clay, ground calcium carbonate, precipitated calcium carbonate, titanium dioxide, aluminum trihydrate, satin white, hollow polymeric pigment, solid polymeric pigment, silica, zinc oxide, barium sulfate, and mixtures thereof. The pigment component of the base coat can have a monodisperse or polydisperse particle size distribution.

The base coat layer is applied to the base paper prior to the application of the paper coating composition. The base coat layer is applied in a similar manner as the paper coating composition as described herein, and may be applied in one or more layers.

The base paper with its coating of the paper coating composition can then be calendered. As used herein, "calendered" refers to a wide range of different operations in which multiple rolls are used to process the coated paper through one or more nips. Examples of such on or off machine calendering processes can include, but are not limited to, single-nip calendering, hot/soft calendering, multi-nip calendering, extended nip calendering, and super calendering processes. The rolls of the calender can be made of a variety of materials.

For example, the rolls can be formed of metal (e.g., steel), have a polymeric covering, and/or a cotton covering, where the different rolls can each having different diameters and optional coverings.

As appreciated, the effect of calendering processes on the coated paper properties depends on the temperature of the roll surfaces, the running speed, the elastic properties of the rolls and the linear load between the rolls, among others. In one embodiment, the linear load range of the calendering process can range from about 35 to about 525 kN/m, and the operating roll temperature can range from about 20° C. to about 300° C. In an additional embodiment, the operating roll temperature can be from about 90° C. to about 150° C. (i.e., where no heat is added to the rolls of the calendering process).

For the various embodiments, calendering the layer of the paper coating composition on the base paper can provide a smoothness of the coating of less than 1.65 PPS-H5 (Parker PrintSurf 5). In addition, the coated paper can further display a TAPPI gloss value of 65 or greater as determined at a 0.75° angle of reflectance. For the various embodiments, coated paper having this smoothness and high gloss can be produced with the thermal rolls of the calender operating with substantially no heat added to the calendering process. Surprisingly, this level of smoothness and gloss is achieved at this calender operating temperature while minimally compacting (i.e., permanent deforming), if at all, the base paper of the coated paper.

For the various embodiments, the combination of high gloss, good smoothness, improved stiffness, and bulk for the coated paper is achieved due to the compressible nature of the paper coating composition of the present disclosure relative to the base paper. The high level, or parts, of the hollow polymeric pigment allows for the paper coating composition to be highly compressible relative to the base paper onto which it is coated.

While not wishing to be bound by theory, it is believed that at least one reason for the highly compressible nature of the paper coating composition is that the compression of the hollow polymeric pigment is largely uninhibited by relatively large amounts of a hard incompressible pigments (e.g., calcium carbonate). So, during a calendering process the paper coating composition can be permanently deformed while minimally altering the original thickness (Z-direction) of the base paper (i.e., little or no compaction). As used herein, the term "Z-direction" refers to a thickness dimension (i.e., the smallest of the three dimensions) of a portion for the coated paper being measured (e.g., the thickness of the base paper).

This allows the compressive forces of the calendering process to permanently deform the coating formed from the coating composition while allowing a plastic response (e.g., an elastic response where compression occurs without compaction and deformation is not permanent) from the base paper. So, during a calendering process the coating formed from the paper coating composition can undergo permanent deformation, while the base paper undergoes minimal, if any, compaction (i.e., permanent deformation) during the calendering process. As a result, the strength properties of the base paper can be essentially retained while still achieving the desired paper surface properties (e.g., gloss and smoothness) from the calendering process.

Because the coating formed from the paper coating composition is so highly compressible relative to the base paper, there is a greater flexibility in the operating conditions of the calendering process (e.g., the nip pressure, calender operating temperature, type of calender, calendering speed, roll hardness) in achieving the desired coated paper features (e.g., smoothness, stiffness factor, bulk factor, gloss, etc.). In addition, these desired coated paper features can be achieved while producing a coated paper that should not be prone to mottle or burnishing and that displays acceptable print strength and acceptable ink setting performance.

It has been found that passing the coated paper through the calendering process compresses the coating formed from the paper coating composition so as to reduce a coating thickness on the base paper by at least 20 percent relative the original coating thickness. Surprisingly, the reduction in coating thickness is uniform across the Z-direction of the coating composition. That is, this level of compression (i.e., at least 20 percent) can be found regardless of location through the Z-direction of the coating composition. At least one reason for this uniform compression can be due to the hollow polymeric pigment of the coating composition being deformed regardless of their level, or position, in the coating structure.

In addition, it has been found that at least 50 percent of the hollow polymeric pigment is deformed in reducing the coating thickness at least 20 percent during the calendering process. That is, at least 50 percent of the hollow polymeric pigment is deformed during the calendering process relative their non-deformed state prior to calendering process. As there is uniform compression through the thickness of the coating, thus at least 50 percent deformation of the hollow polymeric pigment occurs uniformly (e.g., evenly distributed) through the Z-dimension of the coating. As used herein, "deformed" refers to altering the original shape of the hollow polymeric pigment (i.e., their shape prior to calendering) due to the calendering process.

As discussed herein, the compression of the coating formed from the paper coating composition on the base paper can be achieved while minimally altering the original thickness (Z-direction) of the base paper (i.e., little or no compaction). For example, the calendering process changes the coating thickness as discussed herein, while the thickness of the base paper of the coated paper changes no more than about 10 percent relative to its original thickness prior to receiving the coating. It is also possible that the calendering process, while changing the coating thickness as discussed herein, leaves the thickness of the base paper of the coated paper essentially unchanged relative an original thickness of the base paper prior to receiving the coating (i.e., maintaining the original thickness of the base paper).

Figure 1B:
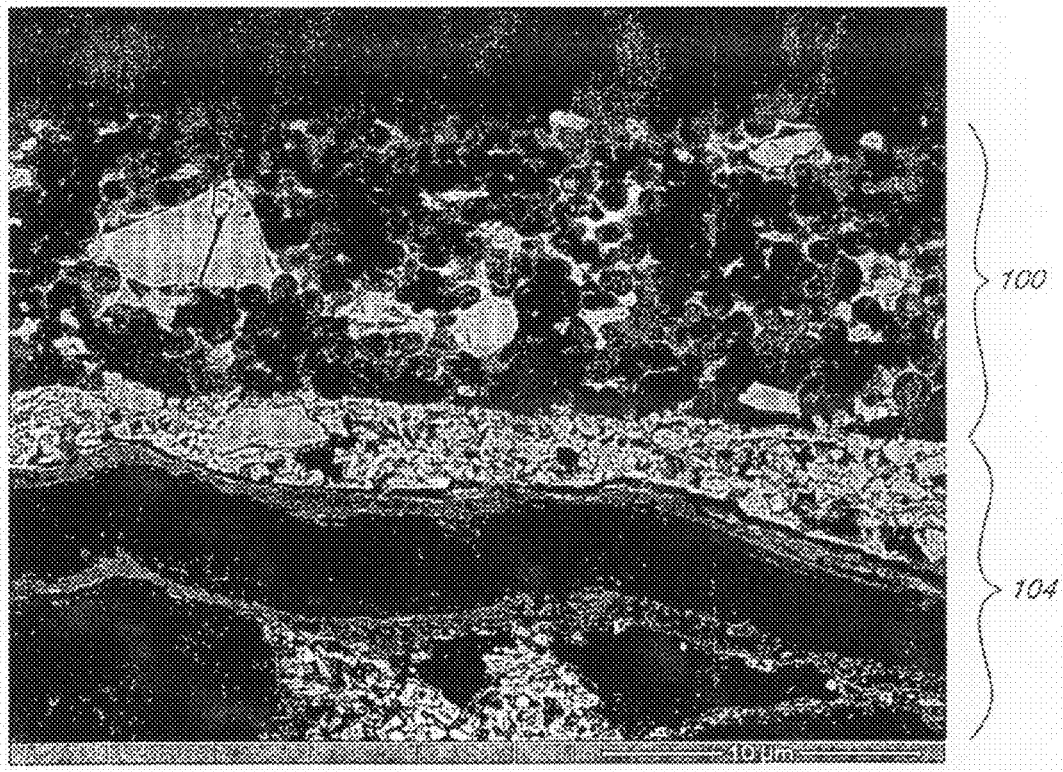

FIGS. 1A-1D provide scanning electron microscope (SEM) images that illustrate the uniform compressibility of coatings formed from the paper coating composition of the present disclosure. The thickness of the coatings and the base paper were obtained from SEM pictures using IMAGEJ software. FIGS. 1A and 1B provide images (taken at different magnifications) of a coating formed from the paper coating composition according to one embodiment of the present disclosure on a precoated base paper in an uncalendered state. As shown, the paper coating composition 100 is coated on a base paper 104.

Figure 1C:
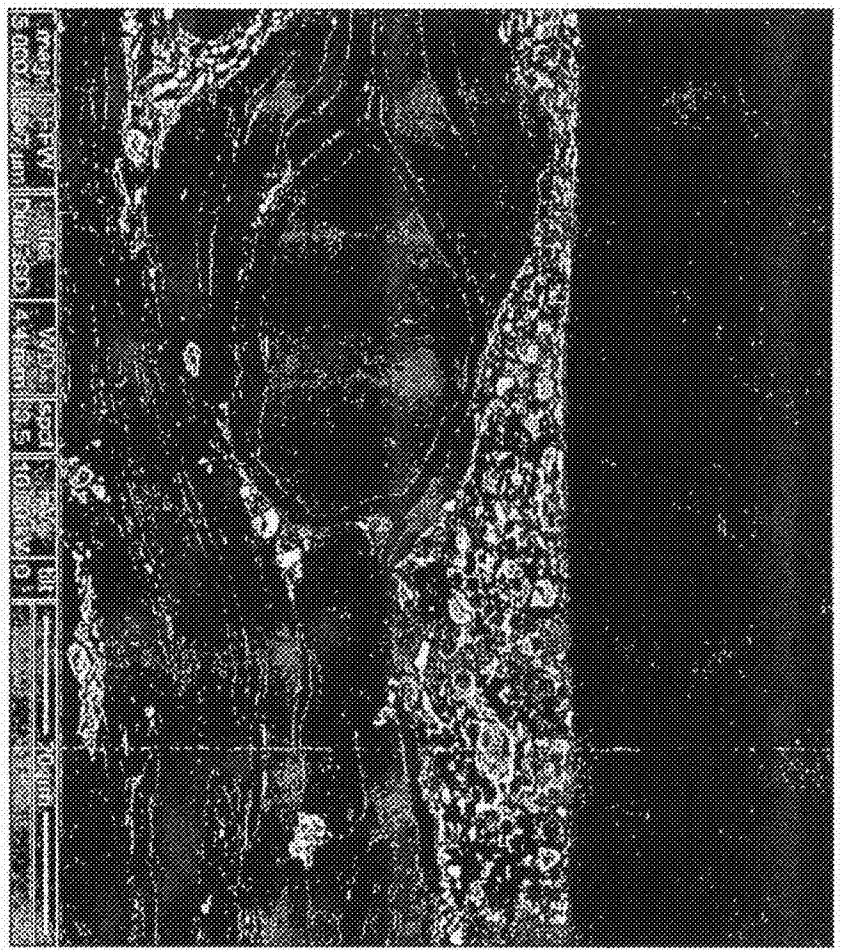
Figure 1D:
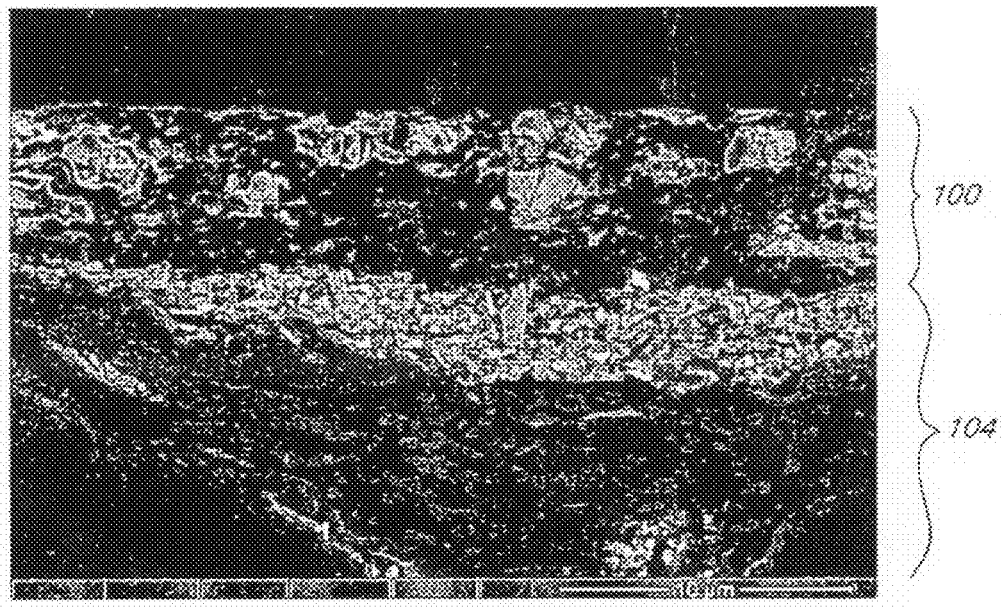

Upon calendering with a Beloit Wheeler Model 753 Laboratory Calender by passing the sheet through three nips with a calender pressure of 140 kN/m and a temperature of 66° C., the hollow polymeric pigment of the coating composition has been uniformly deformed throughout the thickness of the calendered paper coating composition. As illustrated in the images of FIGS. 1C and 1D (taken at different magnifications), the thickness of the paper coating composition has been uniformly reduced by at least 20 percent relative the original coating thickness, with at least 50 percent of the hollow polymeric pigment being deformed during the calendering process. In addition, the original thickness (Z-direction) of the base paper 104 has experienced little or no compaction.

Portions of the calendered coating formed from the coating composition illustrates areas around the inorganic pigment (i.e., the irregularly shaped white portions of the image) where the hollow polymeric pigments have experienced less deformation as compared to other areas of the paper coating composition. This is most likely due to the hard inorganic pigment shielding the hollow polymeric pigment from the compressive force of the calendering process.

In addition to the smoothness and high gloss produced in the calendering process, the coated paper can also display a stiffness factor of at least about 0.5 Gurley/((PPS-S10)(g/m$^2$)). Further, it has been found that there is an at least 25 percent improvement in stiffness of the coated paper of the present disclosure relative to a control. As used herein, a stiffness factor relates to paper stiffness and is calculated from a composite stiffness value of the coated paper divided by the product of the smoothness of the coating and the base paper basis weight. As used herein, the composite stiffness value is determined from the machine direction stiffness and the cross machine direction stiffness of the coated paper according to the formula:

$$\text{Composite Stiffness} = \frac{\text{Machine Direction Stiffness} + \text{Cross Machine Direction Stiffness}}{2}$$

As used herein, the machine direction is the direction in a plane of a paper sheet or web corresponding to the direction of the flow of the stock in the paper machine. Fibers tend to be oriented mainly in the machine direction. Cross Machine direction is the direction in the plane of the paper sheet or web at right angles to the machine direction.

The coated paper also has a bulk factor of at least about 1 mm/(g/m$^2$) which can be expressed as a function of its total weight as follows:

$$\frac{\text{Caliper of Coated Paper (mm)}}{\text{Base Weight of Coated Paper (g/m}^2\text{)}}$$

As used herein, "bulk factor" is an indication of a calendering intensity parameter and is discussed in U.S. Pat. No. 6,254,725, which is incorporated herein by reference in its entirety. For the various embodiments, the basis weight can be expressed as grams per square meter of paper.

The coated paper of the present disclosure can be used in a variety of print applications. These print applications can include, but are not limited to, high quality products like magazines, fliers, catalogs, books, and packaging, which are often printed in multicolor (e.g., 4-color) printing processes where low roughness and uniform surface structure are important for print result. In addition, the coating papers of the present disclosure allow for not only improved printing surfaces, but also maintain their stiffness relative to their pre-calendered condition. So, the coated papers of the present disclosure can simultaneously maintain good print surfaces while maintaining base paper stiffness, two characteristics that have been diametrically opposed to each other in the state of the art until now.

Embodiments of the present disclosure are illustrated by the following examples. It is to be understood that the particular examples, materials, amounts, and procedures are to be interpreted broadly in accordance with the scope and spirit of the invention as set forth herein.

EXAMPLES

The following examples are given to illustrate, but not limit, the scope of this disclosure. Unless otherwise indicated, all parts and percentages are by weight. Unless otherwise specified, all instruments and chemicals used are commercially available.

Test Methods

Volume Median Diameter

The volume median diameter of a hollow polymeric pigment was measured by hydrodynamic chromatography. The method of determining the volume median diameter using hydrodynamic chromatography is presented in "Development and application of an integrated, high-speed, computerized hydrodynamic chromatograph", *Journal of Colloid and Interface Science*, Vol. 89, Issue I, September 1982, Pgs. 94-106, Gerald R. McGowan and Martin A. Langhorst.

SEM Images of Cross-Sectioned Paper

A square specimen of paper was cut from a sample sheet of paper. The square was approximately 15.9 mm on each side and was cut in a region that is away from areas where coating artifacts may be present such as along the uncoated edge of the paper. The square was mounted in an S-shaped Struers Multiclip (Cold Mounting Accessories Brochure; item 40300027) which can hold up to five specimens in one clip.

The specimen was stained by exposing it to osmium vapor overnight. The specimen (mounted in the clip) was placed in a one-liter airtight container along with approximately 0.5 gram of osmium tetroxide crystals. The osmium in the vapor reacts with residual double-bonds present in materials like butadiene, resulting in an effective stain that is useful for identifying these regions in experiments that are sensitive to atomic mass, such as electron microscopy.

The stained specimen and clip were place inside a 3.175 cm Struers Epoform mounting cup and vacuum-embedded in epoxy then allowed to cure for approximately twenty-four hours. Once cured, the mount was metallographically polished with a series of successively-finer abrasives on Streurs Rotopol-V and Buehler Vibromat 2 polishers.

The polished surface was coated with approximately 30 angstroms of a conductive coating (either carbon or chrome) before imaging in the FEI Nova NanoSEM 600 scanning electron microscope (SEM). Images were collected using the backscatter detector where image contrast is based on atomic number so that materials with high atomic number scatter electrons more than low atomic number. This allows differentiation of inorganic fillers (clay, carbonates) from organics and from the osmium-stained regions. The electron beam was run at 10 keV accelerating potential with a 3 nm spot size. Images were collected at varying resolution, depending on the subject being imaged and stored as TIFF images (tagged image file format) for further workup.

The images were processed with the ImageJ software, a public domain program written at the U.S. National Institutes of Health. The coating was isolated for analysis by thresholding the relatively bright coating and converting the thresholded pixels to "black" and the remaining pixels to white. Errors in the thresholding were manually corrected with image editing tools so that the binary representation of the coating was faithful to the image of the true coating.

Dry Pick

Picking is defined as the lifting of a coating, film or fibers from the surface of the base paper during printing. When a print wheel makes contact with a paper sample to deposit the ink, then subsequent negative forces are exerted on the paper as the inked print wheel is removed from the paper surface. The dry pick strength of the coated paper was measured with a method that consists of printing a strip of the coated paper in a print tester at an accelerating rate. The accelerated speed of the print wheel and the tack rating of the ink were adjusted to determine the strength of the coated paper sample at specific printing conditions. If the combination of print wheel speed and ink tack is great enough, then resulting negative forces create picking, which may appear as: white areas on the surfaces of the print wheel and coated paper sample, blisters and textured areas on the surface of the coated paper sample, delamination (surface layer removal) of the coated paper sample, or tearing (complete strength failure) of the base paper sample.

The coating strength was then evaluated by measuring the distance between: the initial inking position, and the initial picking position on the coated paper sample, which was tested at a specific print speed, using a specific tack rated ink. Dry picks for the coated paper samples were measured with an IGT Printability Tester model A1C2-5, using a 15 μm Westvaco Wheel, Westvaco Applicator Rod and IGT Tack Rated Black Printing Inks.

Caliper

The thickness of paper, or the "caliper" as it is sometimes called, is a fundamental property of paper and is often specified when paper is manufactured and sold. As used herein, the "caliper" refers to the perpendicular distance between the two primary surfaces (i.e., the thickness) of the paper or paperboard under specified conditions. In the United States the customary unit of thickness is called the "point", which is a thousandth of an inch. However, the caliper can also be defined in millimeters (mm).

A TMI Model 49-70 Micrometers (Testing Machines, Inc., Ronkonkoma, N.Y.) was used for measuring the caliper of the paper samples provided in the Examples section. The instrument consists of a heavy, solid frame which supports the unit and houses the thickness measurement transducer and associated circuitry. The instrument meets specifications of TAPPI T411. Caliper readings are taken according to TAPPI T411.

Gloss

Paper gloss was measured using a Technidyne Glossmeter model T 480A at an incident angle of 75°. Gloss was measured by measuring multiple sites on a coated paper sample to generate a composite reading of 2 measurements at each of 5 positions in a straight line across each coated paper sample (i.e. far left, left of center, center, right of center, far right). Gloss number reported is an average of the 10 readings.

Coat Weight Measurement

Coat weights were determined by subtracting the mass of a coated paper sample from an uncoated paper sample after the coated paper sample had been dried in a Hot Air oven for 10 minutes at 130-140° C. Specimen samples were cut from 12 sheets with a 100 $cm^2$ cutting die for the base paper and for each coating run. Coat weight number reported is an average of 12 samples.

Stiffness

Stiffness was tested with a Gurley Stiffness tester according to the Instructions for Gurley Stiffness Tester No. 4171. Each test was replicated a total of 6 times.

Smoothness

All smoothness testing was done using the print surface apparatus as described in TAPPI test method T-555. Testing was done both with the 0.5 and 1.0 kg loading on 10 or more sheets per sample of the coated paper after conditioning the coated paper in an atmosphere of 50%±2.0% RH and 23°±1.0° C. for 24 h, and testing the paper in the same atmosphere. Smoothness number reported is an average of 10 measurements.

Formulations

The following materials were used in the coatings formulations:

Carbonate (A): dry calcium carbonate with particle size of 60%<2 microns in water (Hydrocarb 60 available from Omya, Inc, Proctor Vt., USA).

Carbonate (B): dry calcium carbonate with particle size of 90%<2 microns in water (Hydrocarb 90 available from Omya, Inc, Proctor Vt., USA).

Hollow Polymeric Pigment (A): HS 3020 available from The Dow Chemical Company, Midland Mich., USA, 26% solids in water.

Hollow Polymeric Pigment (B): UCARHIDE 4001 available from The Dow Chemical Company, Midland Mich., USA, 30.5% solids in water.

Hollow Polymeric Pigment (C): UCARHIDE 98 available from The Dow Chemical Company, Midland, Mich., USA, 37% solids in water.

Latex (A): carboxylated styrene butadiene latex (CP 615NA available from The Dow Chemical Company, Midland Mich., USA), 50% solids in water.

Latex (B): carboxylated styrene butadiene latex (CP 692NA available from The Dow Chemical Company, Midland Mich., USA), 50% solids in water.

Latex (C): carboxylated styrene butadiene latex (CP 638NA available from The Dow Chemical Company, Midland Mich., USA), 50% solids in water.

Latex (D): carboxylated styrene butadiene latex (PB 6840 available from The Dow Chemical Company, Midland Mich., USA), 49% solids in water.

Latex (E): carboxylated styrene acrylate latex (RAP 800NA available from The Dow Chemical Company, Midland Mich., USA), 50% in water.

Latex (F): carboxylated styrene butadiene latex (XU31398 available from The Dow Chemical Company, Midland Mich., USA).

Clay (A): US No. 1 dry kaolin clay (Hydrofine available from J.M. Huber Company, Macon Ga., USA).

Clay (B): US No. 1 dry kaolin clay with particle size of 90%<2 microns in water (Hydrafine 90 available from J.M. Huber Co., Macon Ga., USA).

Clay (C): dry calcined clay (Ansilex 93 available from Engelhard Company, Sandersville Ga., USA).

$TiO_2$: titanium dioxide—Rutile (Ti-PURE RPS Vantage Slurry (68-71% solid) available from DuPont Company, Wilmington Del.).

Starch: ethylated corn starch (Penford Gum PG290 available from Penford Products Co, Cedar Rapids Iowa).

The above ingredients were mixed sequentially in amounts given in Tables 1 to 5 to obtain the coating formulations used to coat the base paper sheets. The pH of the coating formulations is adjusted to 8.5 by adding NaOH solution (10 weight percent) after all ingredients are mixed. Water is added as needed to adjust the solids content of the formulations and the coating formulations are filtered through a 100 micron, polyamide filter before use.

Base Paper

Paper composed of fibers, with or without fillers and other additives, that make the resulting product suitable for a specified end use can be used as the base paper or paperboard for the embodiments of the present disclosure. Base paper is typically classified according to the type of pulp used to manufacture the paper and basis weight. The following materials were used as base paper in the examples:

Base Paper A: 38 pound light weight uncoated grade base paper available from SAPPI Fine Papers, Muskegon Mich.

Base Paper B: base paper for 80 lb. text available from Appleton Coated, Combined Locks Wis.

Base Paper C: base paper for 100 lb. text available from Appleton Coated, Combined Locks Wis.

Base Paper D: base paper for 100 lb. cover available from Appleton Coated, Combined Locks Wis.

Base Paper E: SBS 14 pt paperboard available from Potlatch Corporation, Lewiston Id.

Base Paper F: StoraEnso 38 pound light weight coated grade base paper available from NewPage Corporation, Miamisburg Ohio.

Coating Procedure

A Laboratory scale coater ("Lab Coater", manufactured by Enz Technick, AG) is used to apply coating formulation to paper. All samples are coated to the desired coat weight using the blade metering application with a bent blade assembly. The coating is dried through a combination of IR dryers and an air flotation dryer to avoid blocking. Alternatively, the coating formulations are applied to the paper with a pilot scale coater ("Pilot Coater"). The Pilot Coater apparatus is either a BELOIT—Short Dwell Head or a BELOIT—Pre-Metered Size Press with a rod for metering coat weight. The coating is dried through a combination of IR dryers and air flotation dryers.

Calendering

Coated paper samples are calendered using a Beloit Wheeler Model 753 Laboratory Calender ("Lab Calender"). Each sheet is passed, coated side against steel, between the two rolls. Calender pressure and temperature are set according the conditions listed in Tables 1-5. Each sheet is calendered through a total of 3 nips. Pilot coater prepared samples are calendered on a VALMET—Super Calender according to conditions listed in Tables 1-5.

Example 1

TABLE 1

| | Control 1 | Sample 1 |
|---|---|---|
| Formulation | 75 parts Clay A per 100 weight parts total pigment<br>15 parts Clay C per 100 weight parts total pigment<br>10 parts $TiO_2$ per 100 weight parts total pigment<br>8 parts Starch<br>7 parts Latex (B) | 45 parts Hollow Polymeric Pigment (A) per 100 weight parts total pigment<br>55 parts Clay A per 100 weight parts total pigment<br>8 Parts Starch<br>7 Parts Latex (A) |
| Solids Content (%) | 56.7 | 41.2 |
| Coater | Pilot Coater with Metered Size Press | Pilot Coater with Metered Size Press |
| Coat weight, ($g/m^2$) | 8.6 | 4.7 |
| Calendering Conditions | 140 kN/m, 65.6° C. | 105 kN/m, 65.6° C. |
| Calender | Super Calender | Super Calender |
| Sheet Gloss | 50.1 | 87.5 |
| Smoothness (PPS-S10) | 1.58 | 1.11 |
| Gurley MD Stiffness (Gurley units) | 18.9 | 23.2 |
| IGT Dry Pick Strength (ft/min) | 234 | 356 |
| Paper | Base Paper A | Base Paper A |

Control 1 and Sample 1 compare one embodiment of the coating composition of the disclosure to a conventional formulation used in lightweight coated paper. As shown in Table 1, Sample 1 has a coat weight of 4.7 $g/m^2$, while the Control has a coat weight of 8.6 $g/m^2$. However, even though the coat weight is approximately half that for Sample 1, the paper coated with the coating composition of Sample 1 provides higher stiffness as compared to the Control. In addition, at lower calendering pressure, the embodiment of the coating composition of Sample 1 provides better pick strength, higher gloss, and improved smoothness as compared to Control 1.

TABLE 2

| | Control 2 | Sample 2 |
|---|---|---|
| Formulation | 50 parts Clay (A) per 100 weight parts total pigment<br>50 parts Carbonate (B) per 100 weight parts total pigment<br>15 parts Latex (C) | 45 parts Hollow Polymeric Pigment (A) per 100 weight parts total pigment<br>55 parts Carbonate (A) per 100 weight parts total pigment<br>12 parts Latex (C) |
| Solids Content (%) | 63.0 | 43.0 |
| Coater | Lab Coater | Lab Coater |
| Coat weight, ($g/m^2$) | 13.6 | 9 |
| Calendering conditions | 140 kN/m, 65.6° C. | 140 kN/m, 65.6° C. |
| Calender | Lab Calender | Lab Calender |
| Sheet Gloss | 65.8 | 89.8 |
| Smoothness (PPS-H5) | 1.93 | 1.32 |
| Smoothness (PPS-S10) | 1.02 | 0.44 |
| Paper | Base Paper B | Base Paper B |

Control 2 and Sample 2 compare one embodiment of the coating composition of the disclosure to a control formulation at the same calendering temperature. The paper formed from the Sample 2 coating composition results in improved gloss and smoothness over Control 2 when the calendering conditions are constant.

TABLE 3

| | Control 3 | Sample 4 |
|---|---|---|
| Formulation | 50 parts Clay (A) per 100 weight parts total pigment<br>50 parts Carbonate (B) per 100 weight parts total pigment<br>15 parts Latex (A) | 45 parts Hollow Polymeric Pigment (A) per 100 weight parts total pigment<br>55 parts Carbonate (A) per 100 weight parts total pigment<br>5 parts Latex (A) |
| Coater | Lab Coater | Lab Coater |
| Coat weight, (g/m$^2$) | 12.6 | 9 |
| Calendering conditions | 140 kN/m, 65.6° C. | 140 kN/m, 65.6° C. |
| Calender | Lab Calender | Lab Calender |
| Gloss | 78.6 | 101.8 |
| Smoothness (PPS-H5) | 1.01 | 0.43 |
| Smoothness (PPS-S10) | 0.88 | 0.38 |
| Stiffness (Gurley units) | 46.2 | 44.8 |
| Paper | Base Paper C | Base Paper C |

Control 3 and Sample 4 compare a conventional coating formulation to one embodiment of the coating composition of the disclosure for a coated free paper application. Sample 4 shows the ability simultaneously obtain a high gloss and smoothness while maintaining high stiffness values for the coated paper.

TABLE 4

| | Sample 5 | Sample 6 |
|---|---|---|
| Formulation | 45 parts Hollow Polymeric Pigment (A) per 100 weight parts total pigment<br>55 parts Carbonate B per 100 weight parts total pigment<br>10 parts Latex (A) | 45 parts Hollow Polymeric Pigment (A) per 100 weight parts total pigment<br>55 parts Carbonate A per 100 weight parts total pigment<br>10 parts Latex (A) |
| Coater | Lab Coater | Lab Coater |
| Coat weight, (g/m$^2$) | 8.7 | 8.9 |
| Calendering conditions | 105 kN/m, 48.9° C. | 105 kN/m, 48.9° C. |
| Calender | Lab Calender | Lab Calender |
| Gloss | 89.8 | 92.5 |
| Smoothness (PPS-H5) | 1.74 | 1.59 |
| Smoothness (PPS-S10) | 1.33 | 1.23 |
| Stiffness, (average Gurley unit) | 285 | 259 |
| IGT, mm to pick | 123 | 135 |
| Paper | Base Paper D | Base Paper D |

Samples 5 and 6 show the unexpected results for paper coated with formulation containing Carbonate A which resulted in better gloss, smoothness, and pick strength than paper coated with a formulation containing Carbonate B.

Example 2

Table 5 shows the results for paper coated with a range of formulations and calendered under a range of conditions. For Base Paper (E), the Pilot Coater and the Super Calender are used, for Base Paper (A), the Lab Coater and Lab Calender are used to prepare the coated paper samples.

TABLE 5

| Base Paper | Coat Wt. g/m$^2$ | Formulation Type | Calendering Conditions (pressure, temperature) | Composite Stiffness (Gurley Units) | Smoothness (PPS-S10) | Basis Wt. (g/m$^2$) | Stiffness Factor |
|---|---|---|---|---|---|---|---|
| E | 3.7 | 45 Parts Hollow Polymeric Pigment A, 55 parts Carbonate A, 8 parts Latex D | 175 Kn/m 26.7° C. | 4078.45 | 0.82 | 245.7 | 20.342 |
| E | 3.7 | 45 Parts Hollow Polymeric Pigment A, 55 parts Carbonate A, 8 parts Latex D | 376.3 kn/m 26.7° C. | 3247.3 | 1.02 | 245.7 | 12.945 |
| E | 3.7 | 45 Parts Hollow Polymeric Pigment A, 55 parts Carbonate A, 8 parts Latex D | 376.3 kN/m 65.6° C. | 3286.2 | 0.90 | 245.7 | 14.861 |

TABLE 5-continued

| Base Paper | Coat Wt. g/m$^2$ | Formulation Type | Calendering Conditions (pressure, temperature) | Composite Stiffness (Gurley Units) | Smoothness (PPS-S10) | Basis Wt. (g/m$^2$) | Stiffness Factor |
|---|---|---|---|---|---|---|---|
| E | 3.7 | 45 Parts Hollow Polymeric Pigment A, 55 parts Carbonate A, 8 parts Latex D | 175 Kn/m 101.7° C. | 3854.6 | 0.90 | 245.7 | 17.393 |
| E | 3.7 | 45 Parts Hollow Polymeric Pigment A, 55 parts Carbonate A, 8 parts Latex D | 376.3 Kn/m 101.7° C. | 3069.55 | 1.11 | 245.7 | 11.286 |
| E | 3.7 | 45 Parts Hollow Polymeric Pigment A, 55 parts Carbonate A, 8 parts Latex D | 175 Kn/m 121.1° C. | 3850.9 | 0.93 | 245.7 | 16.817 |
| E | 3.7 | 45 Parts Hollow Polymeric Pigment A, 55 parts Carbonate A, 8 parts Latex D | 376.3 Kn/m 121.1° C. | 2897.4 | 0.95 | 245.7 | 12.466 |
| A | 4.7 | 45 Parts Hollow Polymeric Pigment A, 55 parts Carbonate A, 8 parts Starch, 7 parts Latex A | 35 Kn/m 148.9° C. | 19.4 | 0.65 | 41.0 | 0.728 |
| A | 4.7 | 45 Parts Hollow Polymeric Pigment A, 55 parts Carbonate A, 8 parts Starch, 7 parts Latex A | 105 Kn/m 148.9° C. | 20.9 | 0.54 | 41.0 | 0.944 |
| A | 4.7 | 45 Parts Hollow Polymeric Pigment A, 55 parts Carbonate A, 8 parts Starch, 7 parts Latex A | 140 Kn/m 148.9° C. | 21.8 | 0.54 | 41.0 | 0.985 |
| A | 4.1 | 35 Parts Hollow Polymeric Pigment A, 55 parts Carbonate A, 8 parts Starch, 7 parts Latex A | 35 Kn/m 148.9° C. | 21 | 0.86 | 41.0 | 0.596 |
| A | 4.1 | 35 Parts Hollow Polymeric Pigment A, 55 parts Carbonate A, 8 parts Starch, 7 parts Latex A | 105 Kn/m 148.9° C. | 21.9 | 0.62 | 41.0 | 0.862 |
| A | 4.1 | 35 Parts Hollow Polymeric Pigment A, 55 parts Carbonate A, 8 parts Starch, 7 parts Latex A | 140 Kn/m 148.9° C. | 20 | 0.59 | 41.0 | 0.827 |
| A | 4.4 | 25 Parts Hollow Polymeric Pigment A, 55 parts Carbonate A, 8 parts Starch, 7 parts Latex A | 105 Kn/m 148.9° C. | 14.5 | 0.61 | 41.0 | 0.580 |
| A | 4.4 | 25 Parts Hollow Polymeric Pigment A, 55 parts Carbonate A, 8 parts Starch, 7 parts Latex A | 140 Kn/m 148.9° C. | 17.4 | 0.58 | 41.0 | 0.732 |
| A | 8.6 | Control Coating 75 parts Clay A, 15 parts Clay C, 10 parts TiO2, 8 Starch, 7 Latex B | 140 Kn/m 65.6° C. | 18.9 | 1.58 | 44.0 | 0.272 |

As can be seen from Table 5, the stiffness factor is improved when formulations containing greater than 25 parts hollow pigment per 100 weight parts total pigment are used to produce the coated paper samples. In addition, each sample prepared has an improved smoothness value as compared to the Control coating.

Example 3

Table 6 shows smoothness values for paper coated with a range of formulations where the level of hollow polymeric particles is increased. The formulations are coated onto Base Paper B, using the Lab Coater and Lab Calendar at 200 pounds per lineal inch (PLI) and 150° F. (65.55° C.).

TABLE 6

| Formulation Type | Smoothness (PPS-S10) | Coat Weight, GSM |
|---|---|---|
| 25 Parts Hollow Polymeric Pigment A 75 parts clay A, 7 parts Latex A 8 parts starch, 56.7% solids | 1.45 | 4.4 |
| 35 Parts Hollow Polymeric Pigment A 65 parts Clay A, 7 parts A, 8 parts starch, 56.7% solids | 1.55 | 4.1 |
| 45 Parts Hollow Polymeric Pigment A 55 parts Clay A, 7 parts Latex A, 8 parts starch, 56.7% solids | 1.21 | 4.7 |

As can be seen from Table 6, the smoothness value of the paper coated with coating compositions including hollow polymeric pigments appears to show a trend of increasing, or getting less smooth, as the level of hollow polymeric pigments in the compositions is increased. However, once the level of hollow polymeric pigments is increased past 35 parts by weight based on total weight of the composition, the smoothness value decreases. In other words, the paper coated with the coating composition has better smoothness once the level of hollow polymeric pigments is increased past 35 parts by weight, based on total weight of the composition.

Example 4

Example 4 compares coating compositions containing two different sized hollow polymeric pigment particles in Samples 12-15 to a conventional formulation used in light weight coated paper, designated as Control 5. This study involves incorporating different levels of a second, smaller polymeric pigment with a first, larger polymeric pigment. In this Example, each sample is prepared and tested at three different calendering pressures. Therefore, Control 5 has a measured value of a property (e.g., gloss) at calendering pressures of 200 PLI, 600 PLI, and 1000 PLI. Further, the coating compositions including two different sized hollow polymeric pigments particles are separated into groups where the ratio of larger polymeric pigment to smaller polymeric pigment is 25/75, 50/50, and 75/25. Each sample is also then calendered at three different pressures. Table 7 presents the formulations and testing conditions of the samples. Table 8 presents the sheet gloss and smoothness values obtained for each Sample.

TABLE 7

| | Control 5 | Sample12 | Sample 13 | Sample 14 | Sample 15 |
|---|---|---|---|---|---|
| Formulation | 50 parts Clay (A) per 100 weight parts total pigment | 45 parts Hollow Polymeric Pigment (A) per 100 weight parts total pigment | 33.75 parts Hollow Polymeric Pigment (A) per 100 weight parts total pigment | 22.5 parts Hollow Polymeric Pigment (A) per 100 weight parts total pigment | 11.25 parts Hollow Polymeric Pigment (A) per 100 weight parts total pigment |
| | 50 parts Carbonate (B) per 100 weight parts total pigment | 55 parts Carbonate (A) per 100 weight parts total pigment | 11.25 parts Hollow Polymeric Pigment (B) per 100 weight parts total pigment | 22.5 parts Hollow Polymeric Pigment (B) per 100 weight parts total pigment | 33.75 parts Hollow Polymeric Pigment (B) per 100 weight parts total pigment |
| | 15 parts Latex (C) | 12 parts Latex (C) | 55 parts Carbonate (A) per 100 weight parts total pigment | 55 parts Carbonate (A) per 100 weight parts total pigment | 55 parts Carbonate (A) per 100 weight parts total pigment |
| | | | 12 parts Latex (C) | 12 parts Latex (C) | 12 parts Latex (C) |
| Calendering Conditions (3 nips) | 150° F. | 150° F. | 150° F. | 150° F. | 150° F. |
| Coat weights (lb/3300 sq. ft.): | 12.43 | 5.98 | 6.01 | 6.29 | 6.27 |
| Calender | Lab | Lab | Lab | Lab | Lab |
| Coating Solids (%) | 65 | 37 | 37 | 37 | 37 |
| Paper | Base Paper F | Base Paper F | Base Paper F | Base Paper F | Base Paper F |

TABLE 8

| | Pounds per Lineal Inch (PLI) | Control 5 | Sample12 | Sample 13 | Sample 14 | Sample 15 |
|---|---|---|---|---|---|---|
| Sheet Gloss (75°) | 200 | 48.28 | 85.39 | 84.37 | 82.23 | 79.89 |
| | 600 | 58.34 | 90.12 | 91.05 | 90.03 | 89.65 |
| | 1000 | 62.71 | 91.39 | 93.46 | 92.38 | 91.74 |
| Smoothness (PPS-S10) | 200 | 1.81 | 0.84 | 0.74 | 0.69 | 0.79 |
| | 600 | 1.43 | 0.56 | 0.63 | 0.60 | 0.59 |
| | 1000 | 1.24 | 0.55 | 0.52 | 0.51 | 0.5 |

As shown in Table 8, the addition of two different sized hollow polymeric particles to the coating composition can enhance desired properties of the coating. For example, the roughness can decrease while the gloss can increase. However, the addition of two different sized hollow polymeric particles to the coating composition does not result in a linear increase or decrease in properties when a second, smaller sized hollow polymeric pigment particle is added in increasing amounts. For example, at a calendering pressure of 600, the roughness changes from 0.56 for the 100/0 composition to 0.63 for the 50/50 composition and finally to 0.60 for the 75/25 composition.

Example 5

In Example 5, Samples 16 and 17 compare coating compositions using two hollow polymeric pigment systems (major hollow polymeric pigment at 33.75 parts, minor hollow polymeric pigment at 11.25 parts per 100 parts total pigment) where there is a particle size difference between the major and minor hollow polymeric pigments. The coating is done using the Lab Coater, and calendered using the Lab Calender. Table 9 shows the compositions and preparation of the samples, as well as the smoothness and gloss results for the final coated paper samples.

TABLE 9

| Coating Description | Sample 16 | Sample 17 |
|---|---|---|
| Formulation Pigments (all based on 100 parts total pigment) | 33.75 parts Hollow Polymeric Pigment (A), 11.25 parts Hollow Polymeric Pigment (B), 10 parts Carbonate (A), 45 parts clay (B) | 33.75 parts Hollow Polymeric Pigment (C), 11.25 parts Hollow Polymeric Pigment (B), 10 parts Carbonate (A), 45 parts clay (B) |
| Particle Size of Major Hollow Polymeric Pigment | Hollow Polymeric Pigment (A) Particle Size | Hollow Polymeric Particle (C) Particle Size |
| Formulation Binders (all based on 100 parts total pigment) | 3 parts starch (A), 3 parts latex (E), 6.5 parts latex (F) | 3 parts starch (A), 3 parts latex (E), 6.5 parts latex (F) |
| Coating Solids | 36% | 36% |
| Paper | Base paper A | Base paper A |
| Coat weight, ($g/m^2$) | 3.5 | 3.5 |
| Calender | Lab Calender | Lab Calender |
| Calendering Conditions | 140 kN/m, 65.6° C. (600 PLI, 150 F) | 140 kN/m, 65.6° C. (600 PLI, 150 F) |
| Smoothness (PPS10) | 1.39 | 1.47 |
| Sheet Gloss | 84.5 | 69.3 |

As can be seen from Table 9, a change in the particle size of the major hollow polymeric pigment component, Hollow Polymeric Pigments (A) and (C), respectively, achieves the unexpected result of an equivalent smoothness with a 15 point lower gloss. In addition, this result is achieved using the same formulation and calendering conditions.

What is claimed is:

1. A paper coating composition, comprising:

a binder;

a first hollow polymeric pigment having a volume median diameter measured by hydrodynamic chromatography of a first predetermined value; and a second hollow polymeric pigment having a volume median diameter measured by hydrodynamic chromatography of a second predetermined value that is at least twenty-five percent smaller than the first predetermined value where the hollow polymeric pigment is derived from a polymer particle comprising an acid-free hydrophilic core copolymer phase made of (meth)acrylate monomers, vinyl ester monomers of carboxylic acids or a mixture thereof, and one or more crosslinking monomers; the core copolymer being base-hydrolyzable at temperatures greater than the Tg of the copolymer wherein the amount of the total hollow polymeric pigment used in the coating composition is about 30 parts to about 65 parts per 100 weight parts of a total polymeric pigment.

2. The paper coating composition of claim 1, where the paper coating composition includes about 9 parts to about 30 parts per 100 weight parts total hollow polymeric pigment of the second hollow polymeric pigment.

3. The paper coating composition of claim 1, where the volume median diameter of the second hollow polymeric pigment is at least 50 percent smaller than the volume median diameter of the first hollow polymeric pigment.

4. The paper coating composition of claim 1, where the volume median diameters of the first hollow polymeric pigment and the second hollow polymeric pigment are in a range from about 300 nanometers to about 1,100 nanometers.

5. The paper coating composition of claim 1, where the first hollow polymeric pigment and the second hollow polymeric pigment can achieve a series of contiguous hollow polymeric pigments that extend through a thickness of a coating formed with the coating composition.

6. The paper coating composition of claim 1, where the first hollow polymeric pigment has a void volume of about 40 to about 60 percent.

7. A paper or paperboard having a coating formed from the paper coating composition of claim 1.

8. A coated paper or paperboard, comprising:

a base paper having a first major surface and a second major surface opposite the first major surface;

a coating over at least one of the first and second major surfaces formed from a coating formulation having:

(i) a binder;

(ii) a first hollow polymeric pigment having a volume median diameter measured by hydrodynamic chromatography of a first predetermined value;

(iii) a second hollow polymeric pigment having the volume median diameter measured by hydrodynamic chromatography of a second predetermined value that is at least twenty-five percent smaller than the first predetermined value;

(iv) an inorganic pigment that has a particle size distribution in which less than 65 percent of the inorganic pigment is less than 2 microns in diameter;

wherein the amount of the total hollow polymeric pigment used in the coating formulation is about 30 parts to about 65 parts per 100 weight parts of a total polymeric pigment.

9. The coated paper or paperboard of claim 8, where the coating over at least one of the first and second major surfaces has a smoothness of less than about 1.65 PPS-H5.

10. The coated paper or paperboard of claim 8, where the coating contains the second hollow polymeric pigment in about 15 parts to about 30 parts per 100 weight parts total hollow pigment.

11. The coated paper or paperboard of claim 10, where at least 50 percent of a total of the first hollow polymeric pigment and the second hollow polymeric pigment in the paper coating composition is deformed relative to a remainder of the total of the first and second hollow polymeric pigment.

12. The coated paper or paperboard of claim 11, wherein the base paper of the coated paper or paperboard has a thickness that changed no more than about 10 percent relative an original thickness of the base paper prior to receiving the coating.

13. The coated paper or paperboard of claim 8, where the inorganic pigment is calcium carbonate.

14. The coated paper or paperboard of claim 8, where the hollow polymeric pigment is derived from a polymer particle comprising:

A. an acid-free hydrophilic core copolymer phase made of (meth)acrylate monomers, vinyl ester monomers of carboxylic acids or a mixture thereof, and one or more crosslinking monomers; the core copolymer being base-hydrolyzable at temperatures greater than the Tg of the copolymer; and B. an intermediate shell copolymer phase which is compatible with the hydrophilic core copolymer phase, the intermediate shell copolymer made of (meth)acrylate monomers having a Tg for their copolymer greater than 50° C.; and one or more vinyl acid monomers; and, optionally, one or more monovinyl aromatic monomers; and, optionally, one or more crosslinking monomers; the intermediate shell copolymer also being compatible with C. an outer rigid shell copolymer which is hydrophobic and crosslinked, the copolymer having a Tg greater than about 80° C., the outer shell copolymer made of one or more monovinyl aromatic monomers; and one or more vinyl acid monomers; and one or more crosslinking monomers; and, optionally, (meth)acrylate monomers having a Tg for their copolymer greater than 50° C.

15. The coated paper or paperboard of claim 14, where the hollow polymeric pigment is joined into clusters by an agglomeration agent or a shearing process.

16. The paper coating composition of claim 1, where the hollow polymeric pigment is derived from a polymer particle further comprising an intermediate shell copolymer phase which is compatible with the hydrophilic core copolymer phase, the intermediate shell copolymer made of (meth)acrylate monomers having a Tg for their copolymer greater than 50° C.; and one or more vinyl acid monomers; and, optionally, one or more monovinyl aromatic monomers; and, optionally, one or more crosslinking monomers.

17. The paper coating composition of claim 2, where the hollow polymeric pigment is derived from a polymer particle further comprising an outer rigid shell copolymer which is hydrophobic and crosslinked, the copolymer having a Tg greater than about 80° C., the outer shell copolymer made of one or more monovinyl aromatic monomers; and one or more vinyl acid monomers; and one or more crosslinking monomers; and, optionally, (meth)acrylate monomers having a Tg for their copolymer greater than 50° C.

18. The paper coating composition of claim 17, further comprising an inorganic pigment that has a particle size distribution in which less than 65 percent of the inorganic pigment is less than 2 microns in diameter.

19. The paper coating composition of claim 18, where the inorganic pigment is calcium carbonate.

20. The paper coating composition of claim 19, where the hollow polymeric pigment is joined into clusters by an agglomeration agent or a shearing process.

* * * * *